US010016994B2

(12) United States Patent
Okazawa et al.

(10) Patent No.: US 10,016,994 B2
(45) Date of Patent: Jul. 10, 2018

(54) RECORDING APPARATUS

(71) Applicant: SEIKO EPSON CORPORATION, Tokyo (JP)

(72) Inventors: Yoshiyuki Okazawa, Nagano (JP); Kazumasa Harada, Nagano (JP); Akira Anami, Fukuoka (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/617,458

(22) Filed: Jun. 8, 2017

(65) Prior Publication Data

US 2017/0267004 A1 Sep. 21, 2017

Related U.S. Application Data

(63) Continuation of application No. 14/576,940, filed on Dec. 19, 2014.

(30) Foreign Application Priority Data

Dec. 27, 2013 (JP) ..... 2013-272477
Feb. 19, 2014 (JP) ..... 2014-029769

(51) Int. Cl.
*B41J 2/01* (2006.01)
*B41J 25/34* (2006.01)
(Continued)

(52) U.S. Cl.
CPC ..... *B41J 25/34* (2013.01); *B41J 11/00* (2013.01); *B41J 11/36* (2013.01); *B41J 29/38* (2013.01); *B65H 1/00* (2013.01)

(58) Field of Classification Search
USPC ..... 347/101, 102, 104
See application file for complete search history.

(56) References Cited

U.S. PATENT DOCUMENTS 5,184,902 A 2/1993 Harada et al.
5,529,414 A * 6/1996 Katano ..... B41J 11/42 271/266
(Continued)

FOREIGN PATENT DOCUMENTS

CN 103204005 A 7/2013
EP 0795412 A1 9/1997
(Continued)

OTHER PUBLICATIONS

The Extended European Search Report for the corresponding European patent application No. 14199831.0 dated Sep. 14, 2016.

*Primary Examiner* — Lam Nguyen

(57) ABSTRACT

A recording apparatus includes a carriage, a transport drive roller, and a plurality of gears. The carriage includes a recording head configured to record onto a medium. The carriage is configured to move in a movement region in a first direction and a second direction that is an opposite direction thereto. The transport drive roller is configured to transport the medium to a recording region in which the recording head performs recording. The plurality of gears are configured to transmit power of a motor to the transport drive roller. When the carriage is positioned at an end of the movement region in the second direction, at least a portion of one of the plurality of gears overlaps the carriage when viewed along a vertical direction that is parallel to a direction of gravity and overlaps the recording head when viewed along an axial direction of the transport drive roller.

2 Claims, 23 Drawing Sheets

(51) Int. Cl.

| | |
|---|---|
| ***B41J 29/38*** | (2006.01) |
| ***B41J 11/00*** | (2006.01) |
| ***B65H 1/00*** | (2006.01) |
| ***B41J 11/36*** | (2006.01) |

(56) References Cited

U.S. PATENT DOCUMENTS

| | | | | |
|---|---|---|---|---|
| 5,598,201 | A | 1/1997 | Stodder et al. | |
| 6,059,286 | A | 5/2000 | Miyashita | |
| 6,102,533 | A | 8/2000 | Nozawa et al. | |
| 6,152,555 | A | 11/2000 | Nozawa et al. | |
| 6,276,780 | B1 | 8/2001 | Carrese et al. | |
| 6,293,652 | B1 | 9/2001 | Arashima et al. | |
| 6,302,530 | B1 | 10/2001 | Shimada et al. | |
| 6,302,535 | B1 | 10/2001 | Sturgeon et al. | |
| 6,375,315 | B1 | 4/2002 | Steinmetz et al. | |
| 6,488,369 | B1 | 12/2002 | Steinmetz et al. | |
| 7,258,431 | B2 | 8/2007 | Shinada et al. | |
| 7,744,187 | B2 | 6/2010 | Iwakura | |
| 8,297,738 | B1 | 10/2012 | Kodama et al. | |
| 8,297,739 | B1 | 10/2012 | Kodama et al. | |
| 8,439,482 | B1 | 5/2013 | Kodama et al. | |
| 2002/0085075 | A1 | 7/2002 | Shinada et al. | |
| 2002/0158948 | A1 | 10/2002 | Miyazawa et al. | |
| 2006/0023053 | A1 | 2/2006 | Sasa et al. | |
| 2007/0211086 | A1 | 9/2007 | Shimomura et al. | |
| 2010/0073423 | A1 | 3/2010 | Nakata et al. | |
| 2012/0050430 | A1* | 3/2012 | Stiehler | B41J 13/025 347/101 |
| 2013/0044152 | A1 | 2/2013 | Sawai | |
| 2013/0057629 | A1 | 3/2013 | Miyamoto et al. | |
| 2013/0182046 | A1 | 7/2013 | Kodama et al. | |
| 2013/0182047 | A1 | 7/2013 | Nozawa et al. | |
| 2013/0182048 | A1 | 7/2013 | Nozawa et al. | |
| 2013/0182049 | A1 | 7/2013 | Kodama et al. | |
| 2013/0182052 | A1 | 7/2013 | Matsuzaki et al. | |
| 2013/0182053 | A1 | 7/2013 | Kodama et al. | |
| 2014/0152746 | A1 | 6/2014 | Kodama et al. | |
| 2014/0210917 | A1 | 7/2014 | Kodama et al. | |
| 2014/0368585 | A1 | 12/2014 | Nozawa et al. | |
| 2015/0077486 | A1 | 3/2015 | Kodama et al. | |
| 2016/0129696 | A1 | 5/2016 | Nozawa et al. | |
| 2016/0375688 | A1 | 12/2016 | Kodama et al. | |

FOREIGN PATENT DOCUMENTS

| | | | |
|---|---|---|---|
| EP | 0876923 | A2 | 11/1998 |
| EP | 0993954 | A2 | 4/2000 |
| EP | 1029698 | A2 | 8/2000 |
| EP | 1086821 | A2 | 3/2001 |
| GB | 2150505 | A | 7/1985 |
| JP | 10-218421 | A | 8/1998 |
| JP | 10-235890 | A | 9/1998 |
| JP | 10-286972 | A | 10/1998 |
| JP | 2002-240813 | A | 8/2002 |
| JP | 2003-011448 | A | 1/2003 |
| JP | 2003-065798 | A | 3/2003 |
| JP | 2003-520713 | A | 7/2003 |
| JP | 2004-209662 | A | 7/2004 |
| JP | 2006-036483 | A | 2/2006 |
| JP | 2006-247932 | A | 9/2006 |
| JP | 2006-289770 | A | 10/2006 |
| JP | 2007-030388 | A | 2/2007 |
| JP | 2010-023458 | A | 2/2010 |

* cited by examiner

RECORDING APPARATUS

CROSS-REFERENCE TO RELATED APPLICATIONS

This application is a continuation application of U.S. patent application Ser. No. 14/576,940 filed on Dec. 19, 2014. This application claims priority to Japanese Patent Application No. 2013-272477 filed on Dec. 27, 2013 and Japanese Patent Application No. 2014-029769 filed on Feb. 19, 2014. The entire disclosures of U.S. patent application Ser. No. 14/576,940 and Japanese Patent Application Nos. 2013-272477 and 2014-029769 are expressly incorporated herein by reference.

BACKGROUND

Technical Field

The present invention relates to a recording apparatus represented by facsimile machines, printers, and the like.

Related Art

A so-called serial printer is a printer that completes the recording by alternately executing a paper transport operation of a predetermined amount of paper and a recording operation that accompanies the movement in the direction of the paper width of a carriage provided with a recording head. In addition, the types of inkjet printers are a type that provides an ink cartridge in the carriage and a type that provides the ink cartridge independent of the carriage and connects the ink cartridge to the carriage by an ink tube. In either type of serial printer, recording is performed by the reciprocating operation of the carriage in a predetermined range.

In an inkjet printer, a pair of transport rollers for transporting a recording sheet, as an example of a medium, is provided on the upstream side of the recording head. The transport roller pair is usually configured from a drive roller that is driven by a motor and a driven roller that presses toward the drive roller (e.g., Japanese Laid-Open Patent Publication No. 2006-247932).

The drive roller is produced by forming a high friction layer on the outer peripheral surface of a solid metal shaft or a hollow metal shaft. The driven roller is formed by resin molding. The recording paper is transported to the downstream side by the rotational drive of the drive roller in the state in which the paper is pinched by the drive roller and the driven roller.

Here, when the recording paper is transported by this kind of transport roller pair, the back edge of the paper is forcefully ejected when the transport roller pair releases. As a result, the phenomenon of disruption of the transport accuracy and the so-called kicking phenomenon occur. This kind of kicking phenomenon conspicuously occurs particularly with thick recording paper (e.g., glossy paper, paper board).

In addition, there is a demand for a further reduction in printer size. In particular, users are requesting further reductions in the sizes of mobile printers that they expect to carry.

Now, when the width dimension of the printer is examined, the width dimension is determined for the most part by the width of the movement region of the carriage, and the sizes and the placement positions of structural elements that are arranged on the outside of the movement region. Because the movement region of the carriage is determined by the paper width and cannot be reduced, a reduction of the space occupied by structural elements that are arranged outside of the carriage movement region is essential in reducing the width dimension.

Japanese Laid-Open Patent Publication No. 2006-289770 discloses a configuration in which an encoder scale is arranged outside of the carriage movement region as an example.

As a means to suppress the kicking phenomenon described above, Japanese Laid-Open Patent Publication No. 2006-247932 discloses a technology that forms in advance a gap smaller than the thickness of the recording paper between the drive roller and the driven roller. According to this, the kicking phenomenon can be suppressed even if the thickness of the recording paper is increased.

However, in the structure described above in Japanese Laid-Open Patent Publication No. 2006-247932, sometimes it was difficult to adequately manage the gap between the drive roller and the driven roller, and an adequate pinching force was not obtained when the thickness of the recording paper was thin. In these cases, the problem was that the kicking phenomenon occurred. That is, the problem was the difficulty in more satisfactorily (reliably) suppressing the kicking phenomenon in a simple structure.

Also, a reduction in the height dimension, in addition to the width dimension, of the apparatus is also requested for printers. However, when the height dimension of the apparatus is reduced, the volume of the carriage becomes smaller. In particular, a smaller ink cartridge must be designed for the type that provides the ink cartridge in the carriage. Therefore, if the carriage volume is ensured while the height dimension of the apparatus is reduced, the width of the carriage must be increased, but the width dimension of the apparatus will increase. In other words, there is a trade-off relationship between the carriage volume, namely the volume of the ink cartridge, and the width dimension of the apparatus. The problem was the difficulty in establishing both.

SUMMARY

The present invention solves at least a portion of the problems described above and can be implemented in the following modes or embodiments.

A recording apparatus according to one embodiment includes a carriage, a transport drive roller, and a plurality of gears. The carriage includes a recording head configured to record onto a medium. The carriage is configured to move in a movement region in a first direction and a second direction that is an opposite direction thereto. The transport drive roller is configured to transport the medium to a recording region in which the recording head performs recording. The plurality of gears are configured to transmit power of a motor to the transport drive roller. When the carriage is positioned at an end of the movement region in the second direction, at least a portion of one of the plurality of gears overlaps the carriage when viewed along a vertical direction that is parallel to a direction of gravity and overlaps the recording head when viewed along an axial direction of the transport drive roller.

BRIEF DESCRIPTION OF THE DRAWINGS

Referring now to the attached drawings which form a part of this original disclosure:

FIG. 23A shows the embodiment, and FIG. 23B shows a comparative example.

DETAILED DESCRIPTION OF EXEMPLARY EMBODIMENTS

Embodiments of the present invention are explained below with reference to the drawings. The present invention is not limited to the embodiments described below and can have various modifications within the scope of the invention described in the scope of the patent claims. With the premise that these embodiments are included in the scope of the present invention, embodiments of the present invention are explained below.

Figure 1:
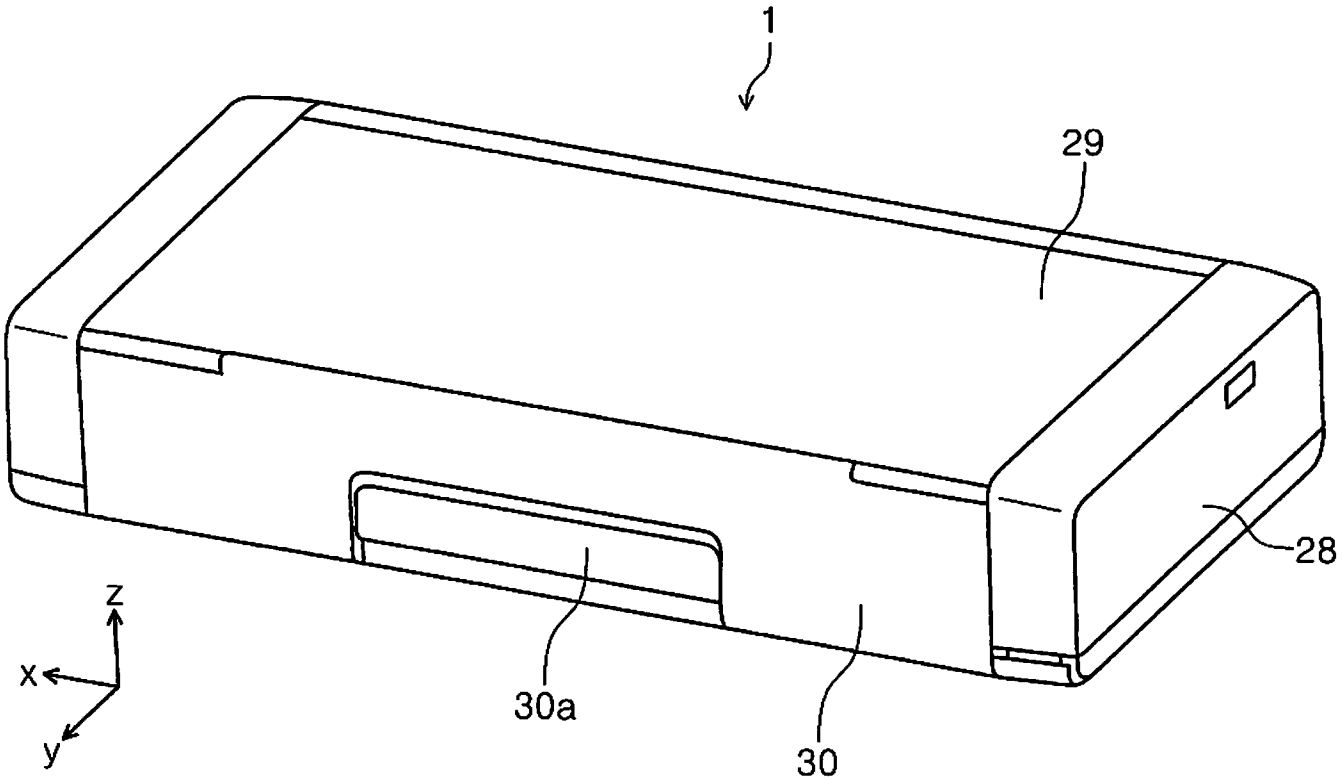
FIG. 1 is an exterior perspective diagram of a printer related to the embodiments.
Figure 2:
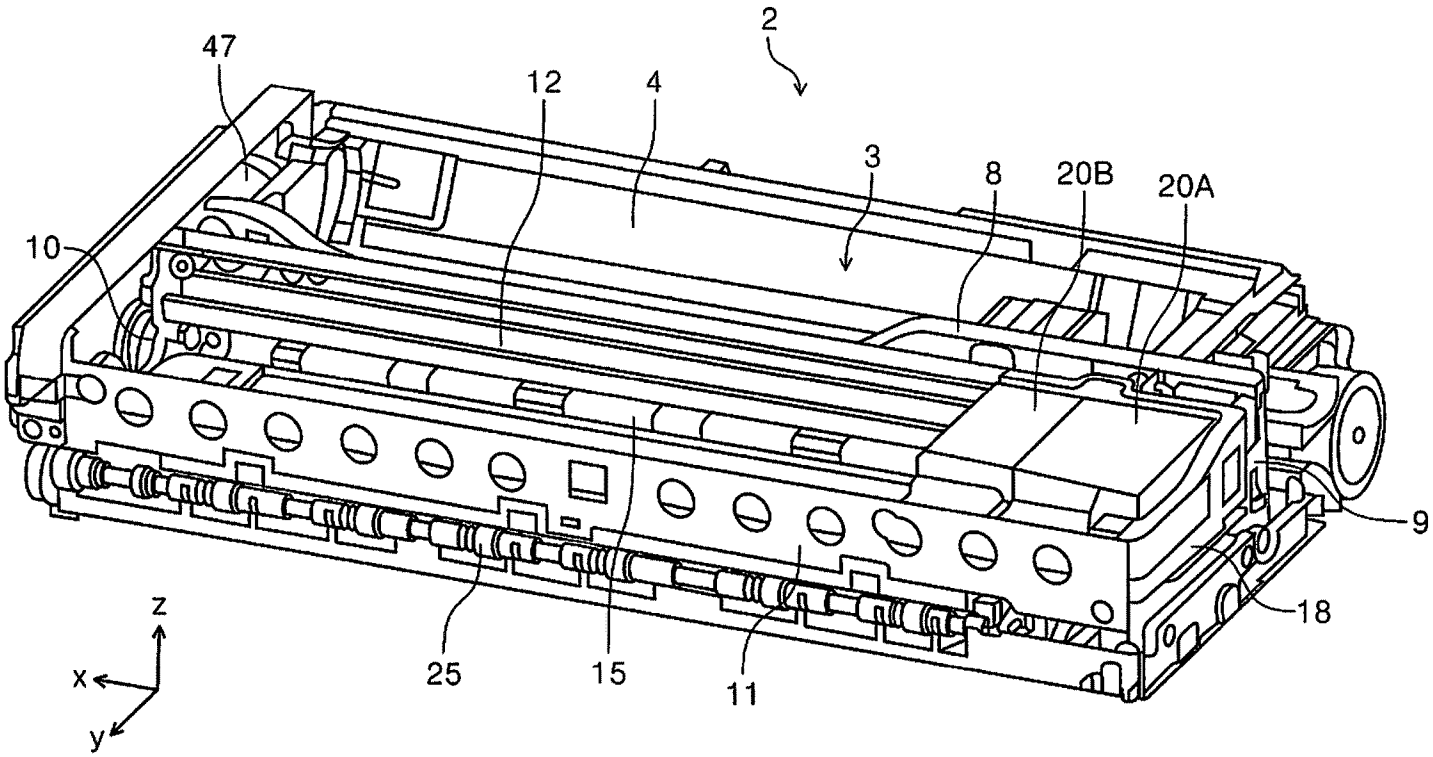
FIG. 2 is a perspective diagram of the apparatus body of a printer related to the embodiments.
Figure 3:
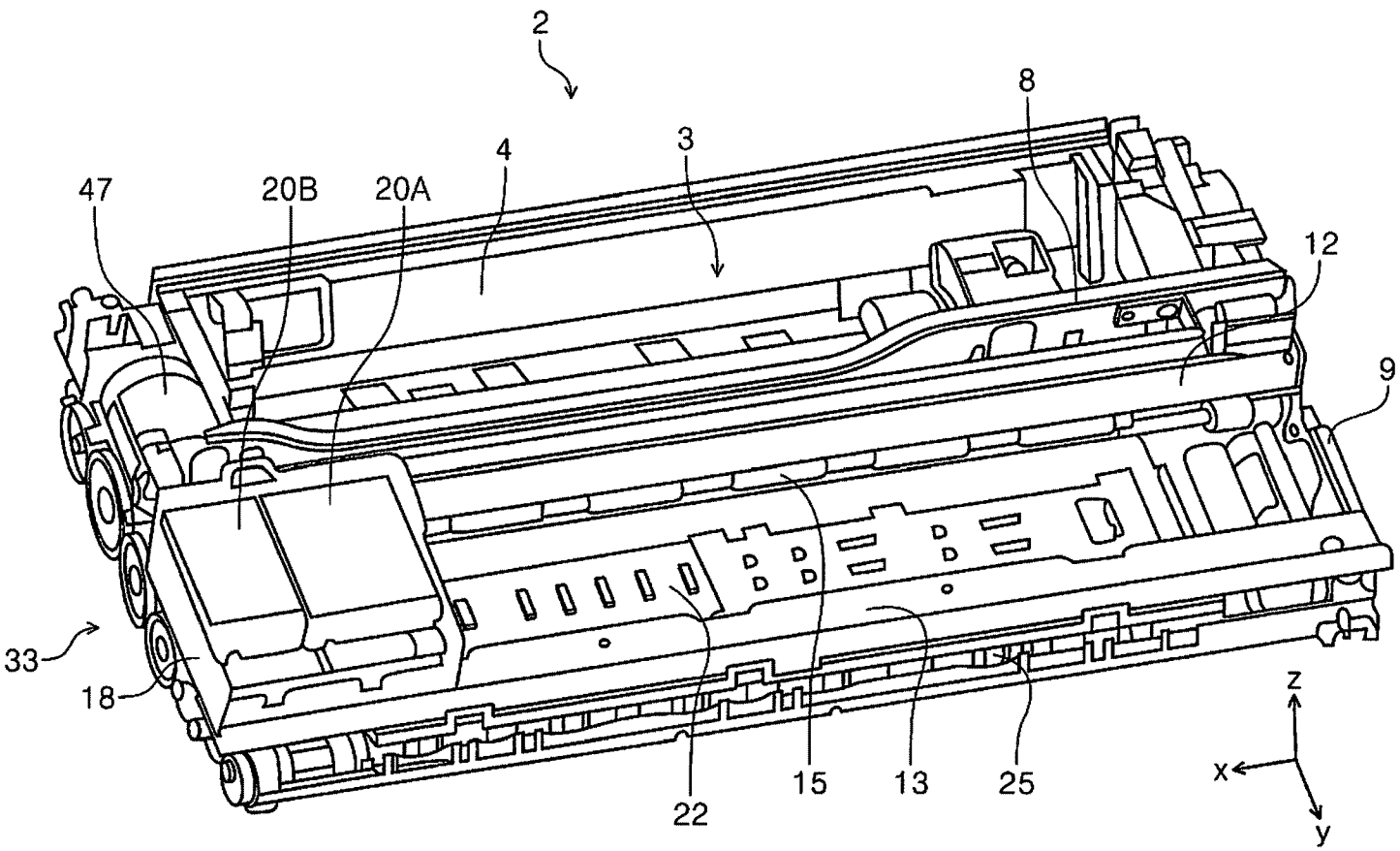
FIG. 3 is a perspective diagram of the apparatus body of a printer related to the embodiments.
Figure 4:
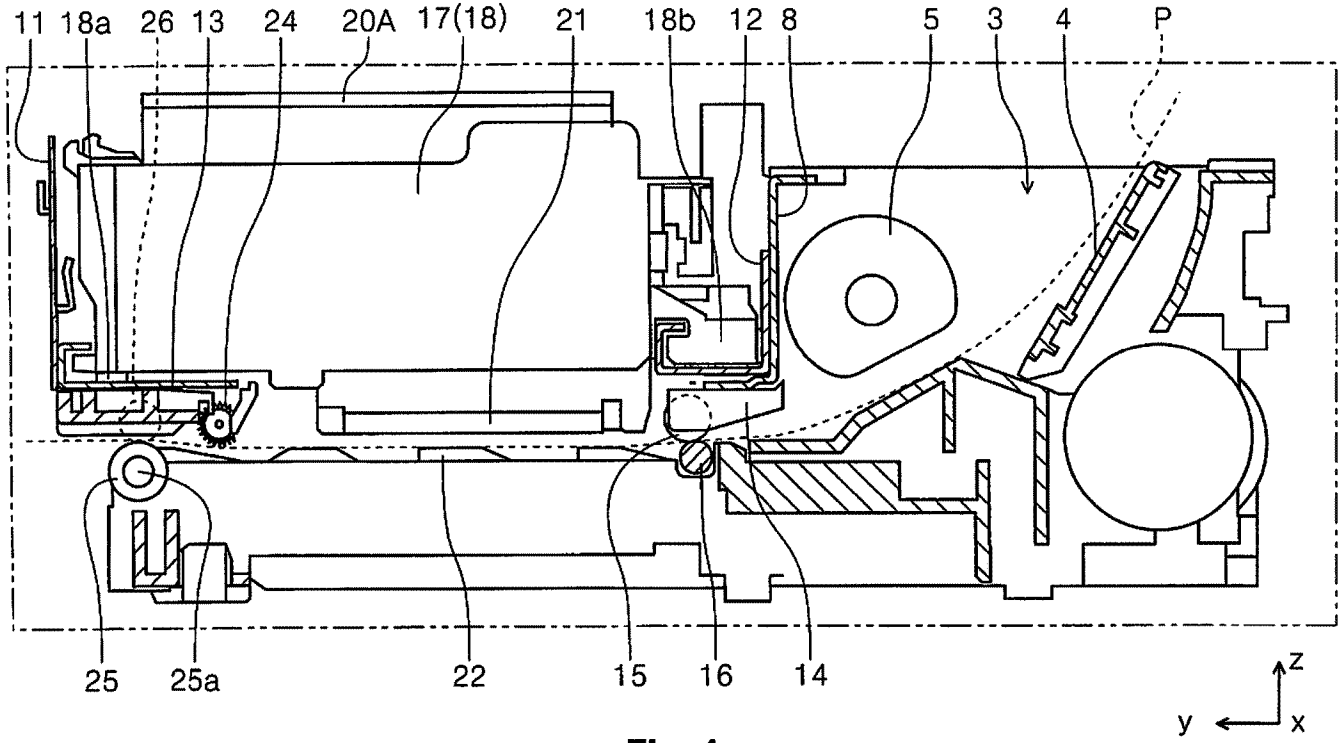
FIG. 4 is a side cross-sectional diagram showing the paper transport path of a printer related to the embodiments.
Figure 5:
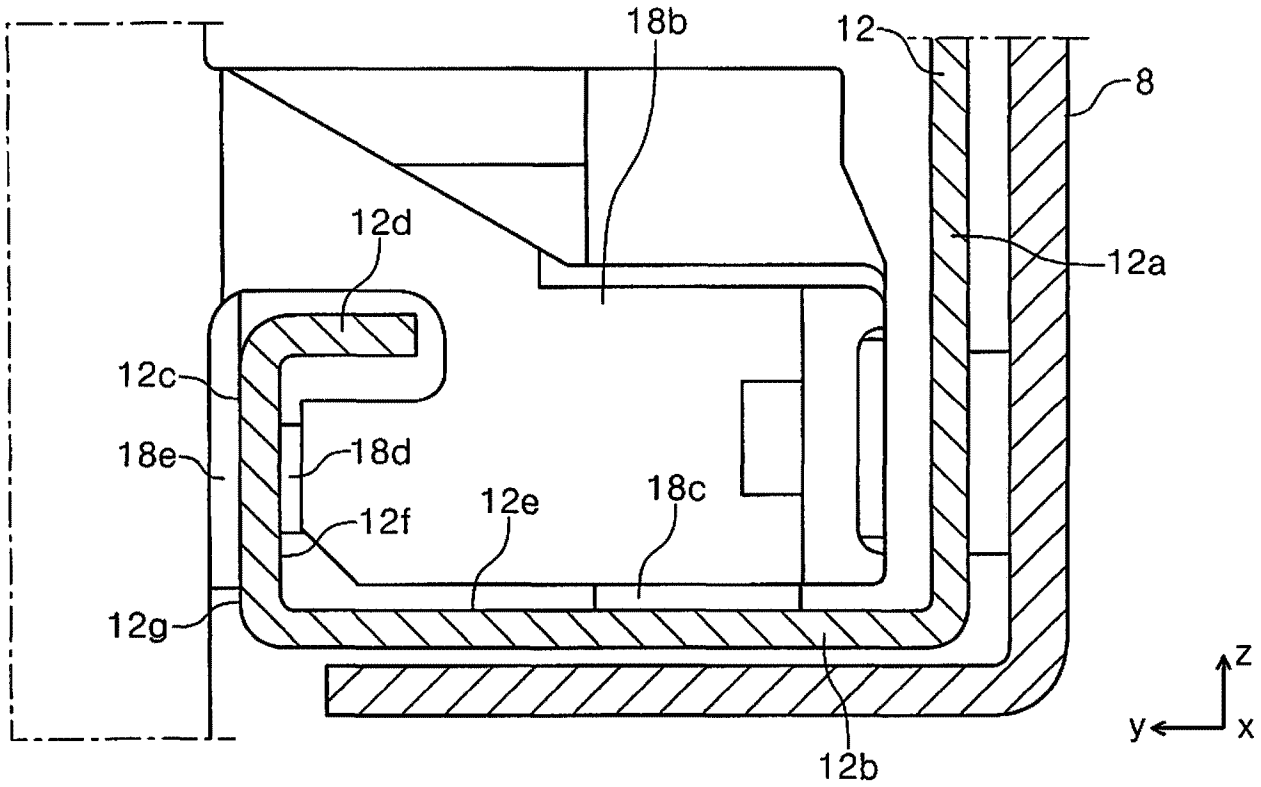
FIG. 5 is a partial enlarged diagram of FIG. 4.
Figure 6:
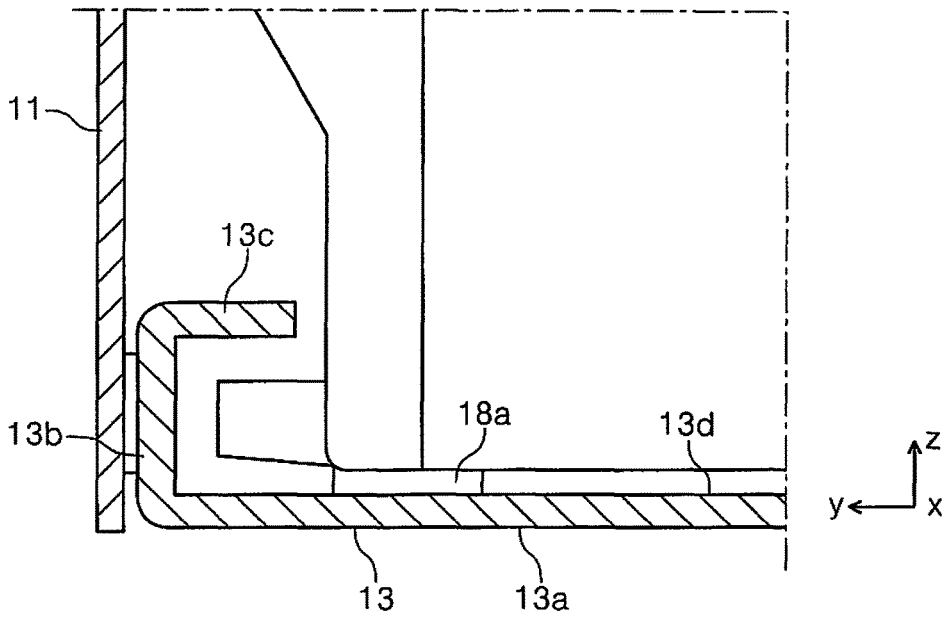
FIG. 6 is a partial enlarged diagram of FIG. 4.

FIG. 1 is an exterior perspective diagram of an inkjet printer (hereinafter, referred to as the "printer") 1, which is an embodiment of the "recording apparatus" related to the present invention. FIG. 2 and FIG. 3 are perspective diagrams of the apparatus body (state in which the case constituting the exterior is removed) 2 of the printer 1. FIG. 4 is a side cross-sectional diagram showing the paper transport path of the printer 1. FIG. 5 and FIG. 6 are partial enlarged diagrams of FIG. 4.

Figure 7:
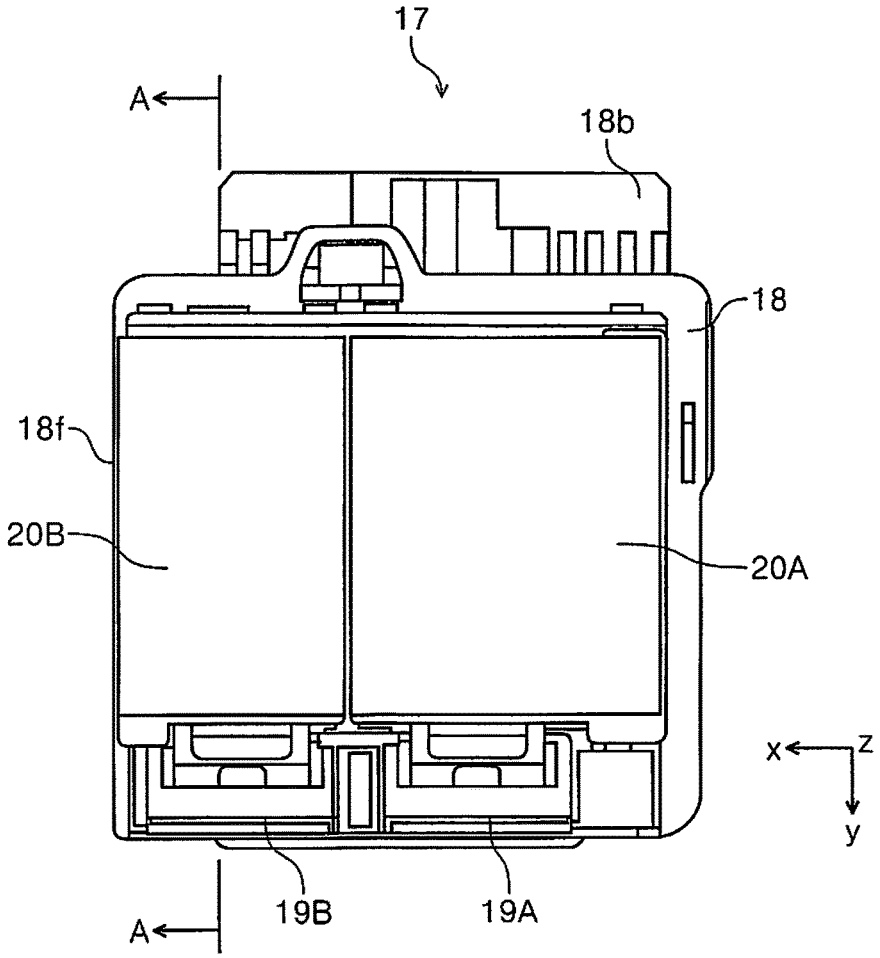
FIG. 7 is a planar diagram viewed from above the carriage.
Figure 8:
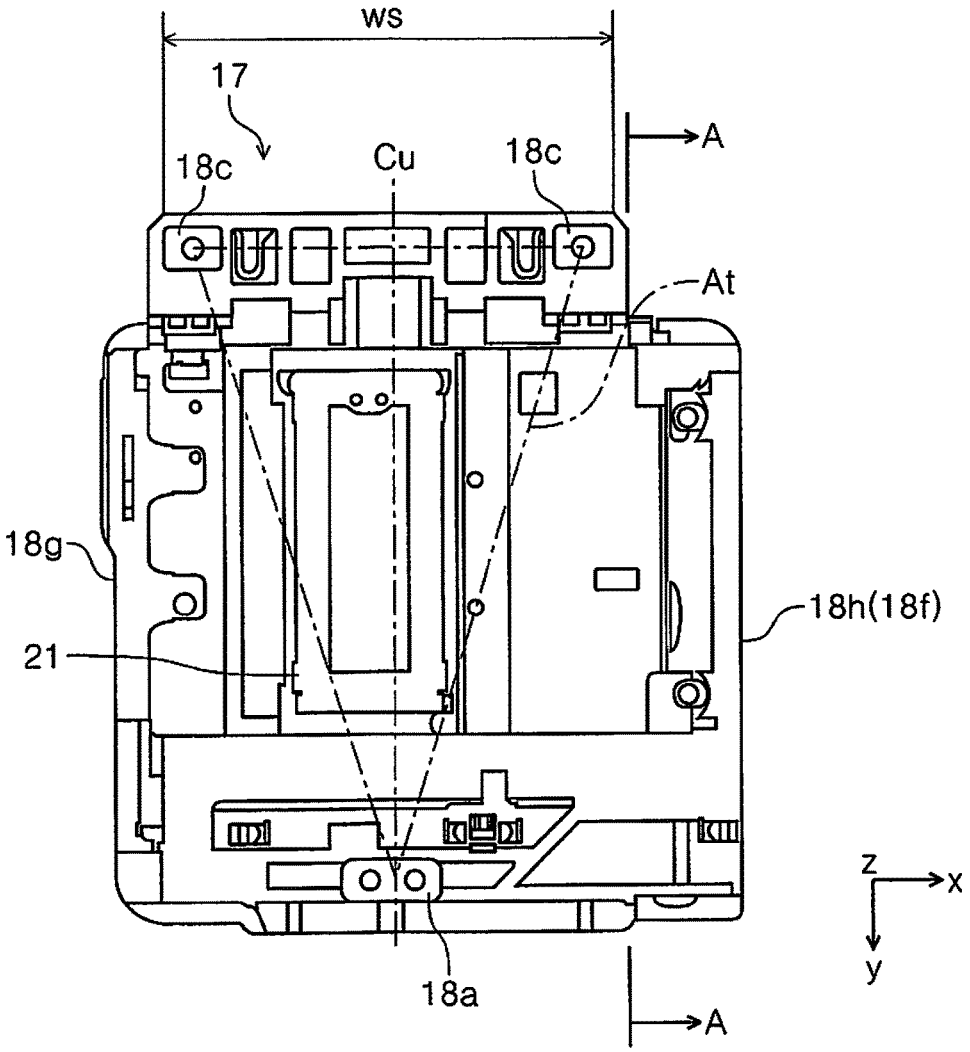
FIG. 8 is a planar diagram viewed from below the carriage.
Figure 9:
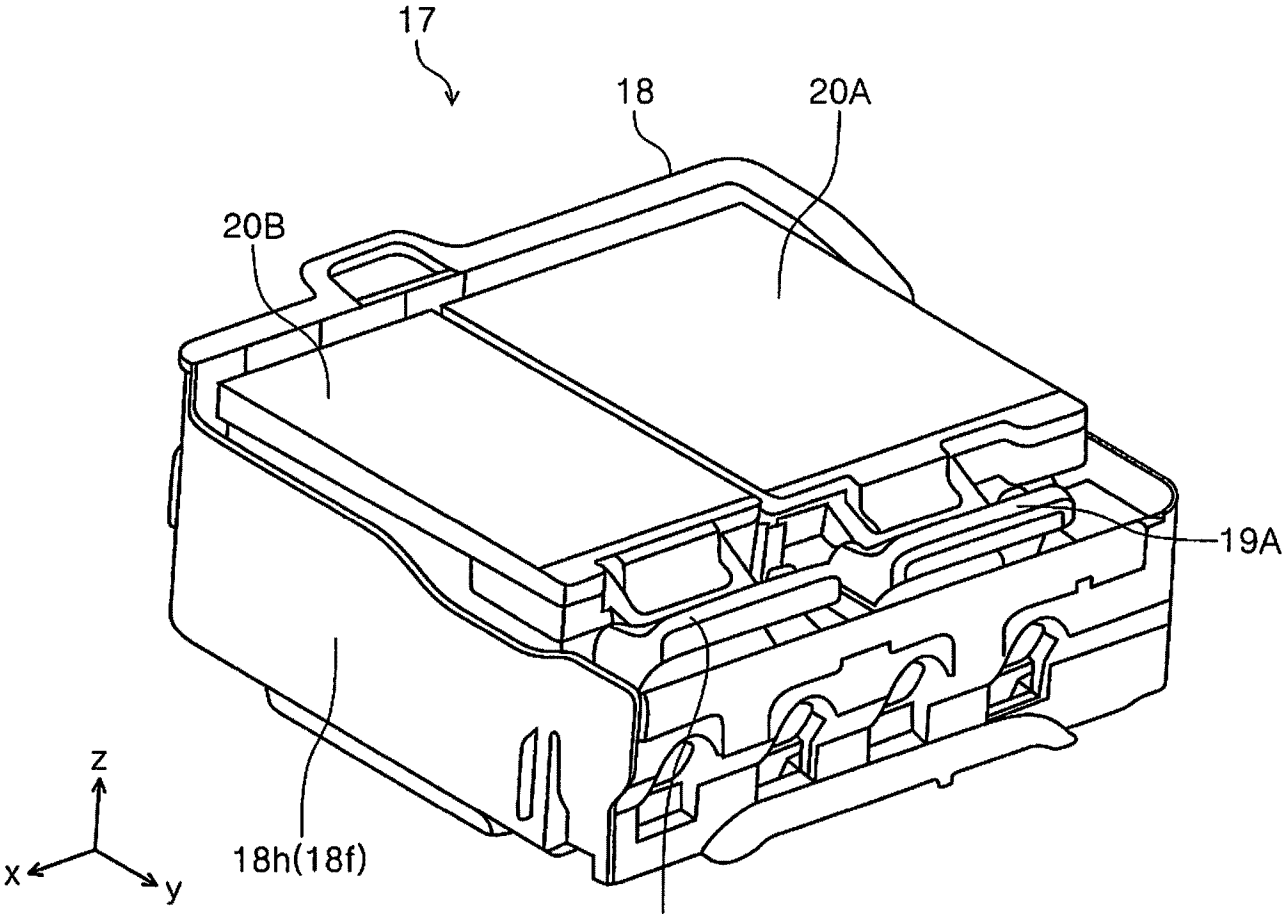
FIG. 9 is a perspective diagram of the carriage viewed at an incline from above and in front of the apparatus.
Figure 10:
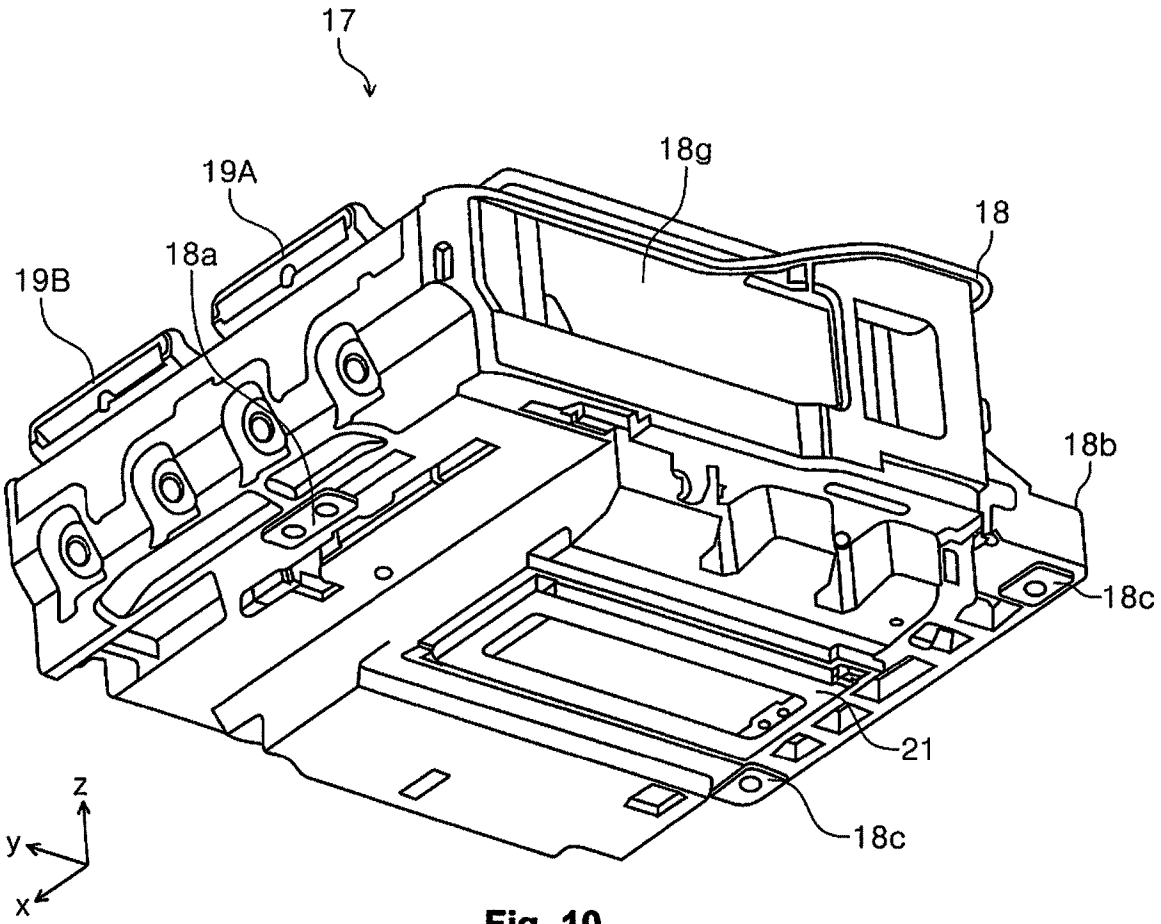
FIG. 10 is a perspective diagram of the carriage viewed at an incline from below and in front of the apparatus.
Figure 11:
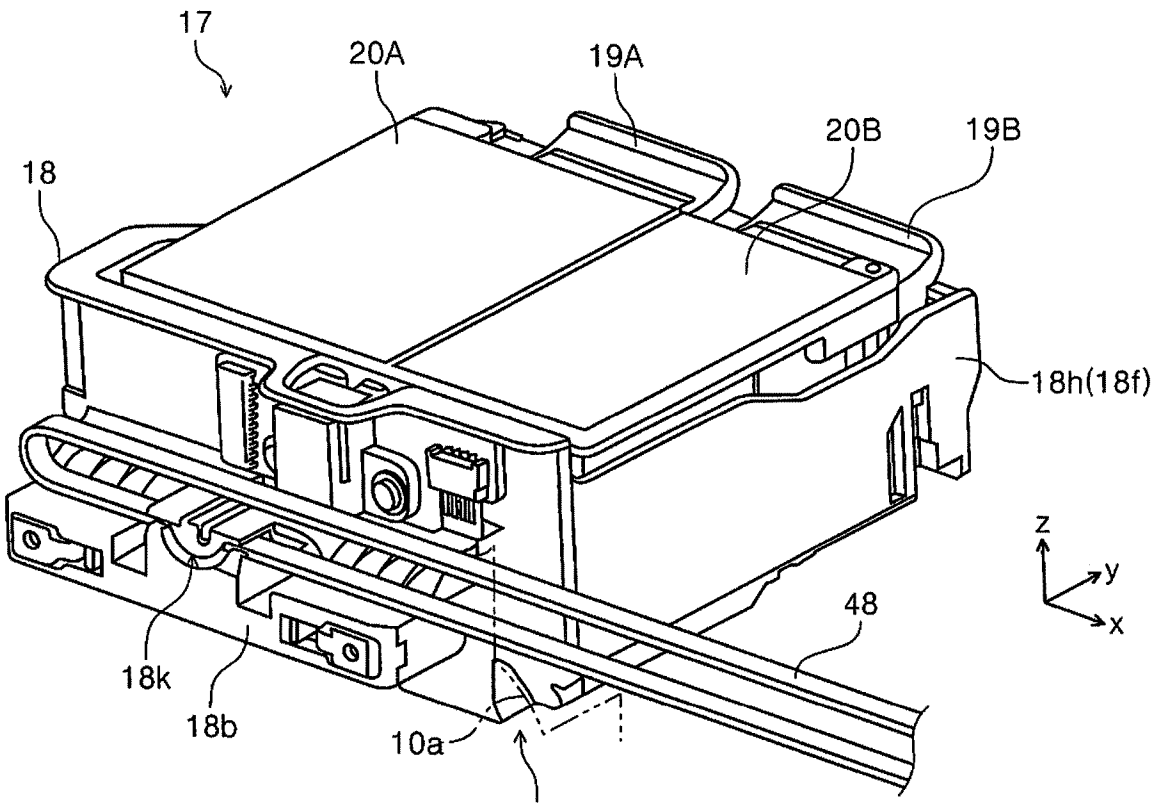
FIG. 11 is a perspective diagram of the carriage viewed at an incline from above and behind the apparatus.
Figure 12:
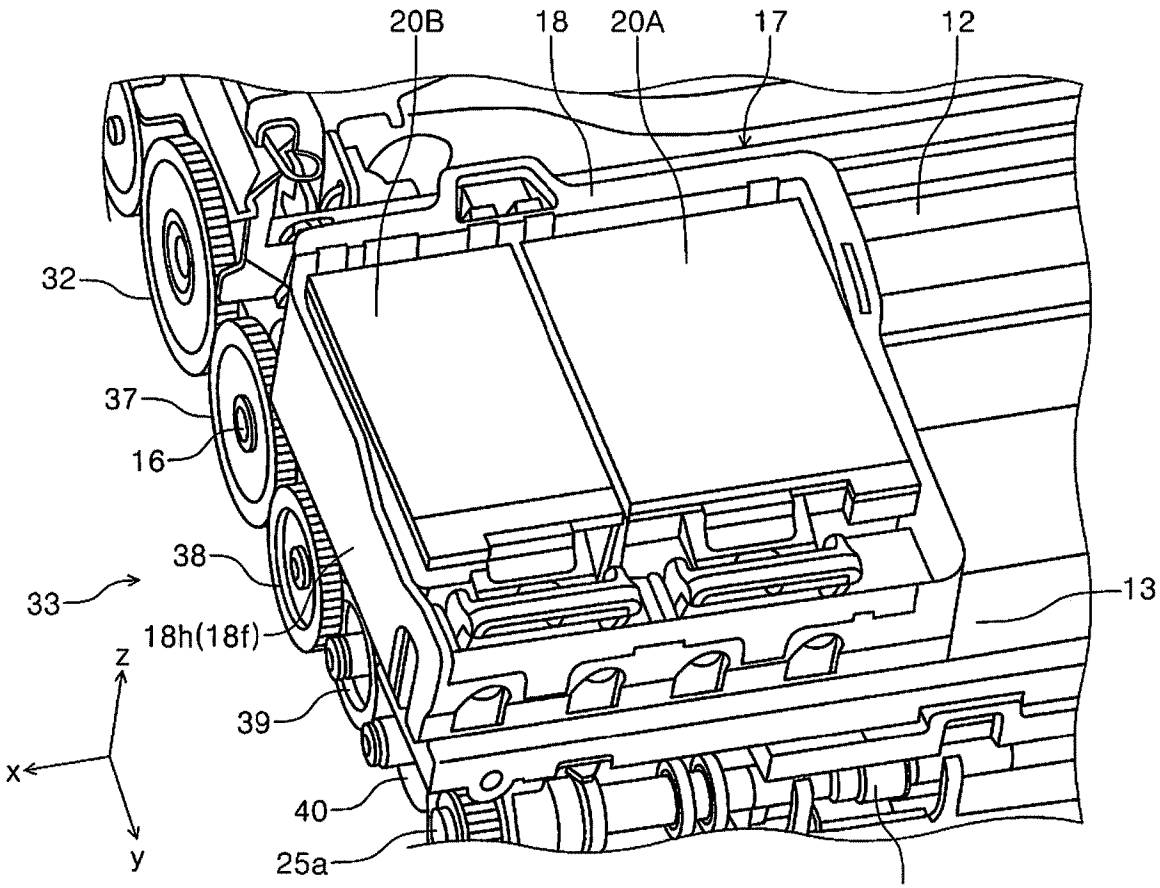
FIG. 12 is a perspective diagram of the carriage when position at the end part on the left side.
Figure 13:
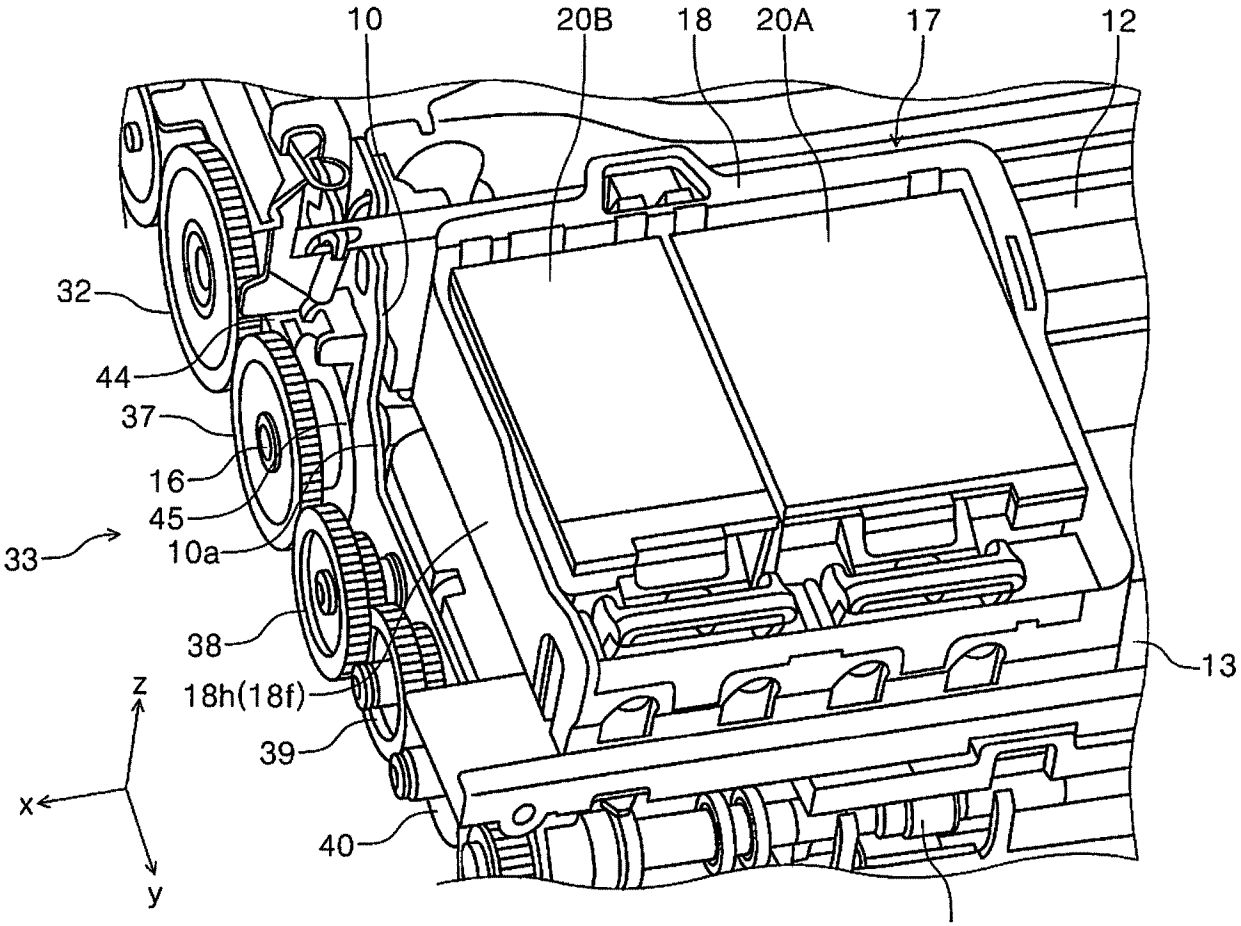
FIG. 13 is a perspective diagram of the carriage positioned slightly closer to the home position side than the end part on the left side.
Figure 14:
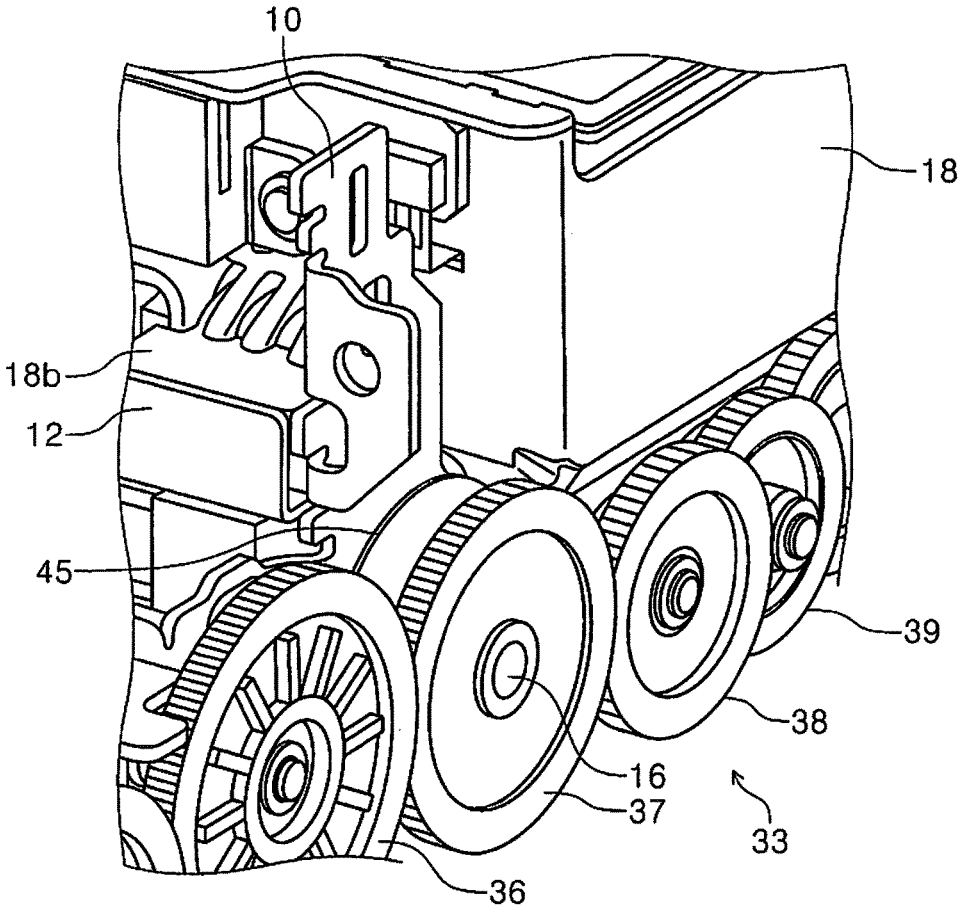
FIG. 14 is a perspective diagram showing the gear group and the rotary scale.
Figure 15:
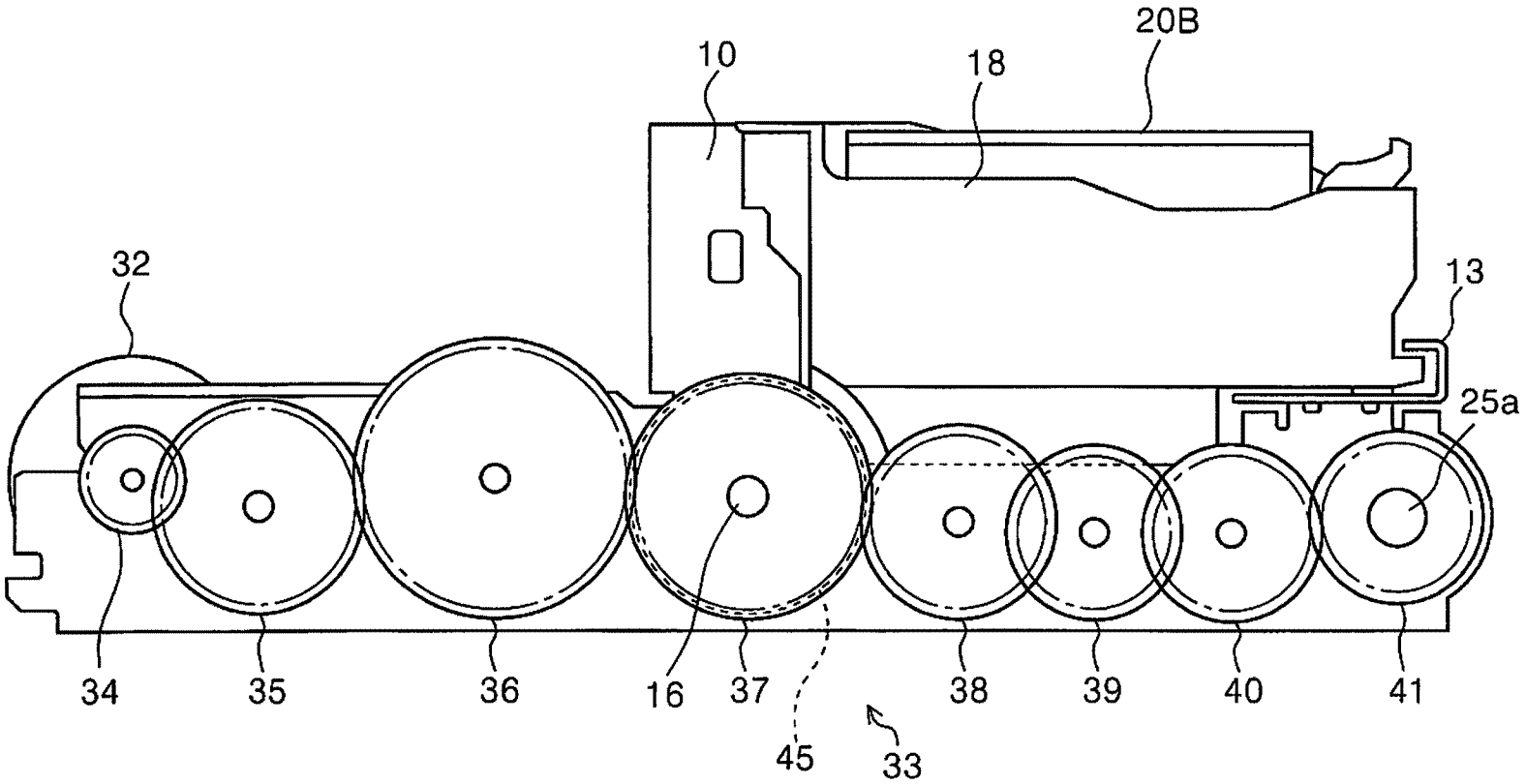
FIG. 15 is a front diagram of the gear group.
Figure 16:
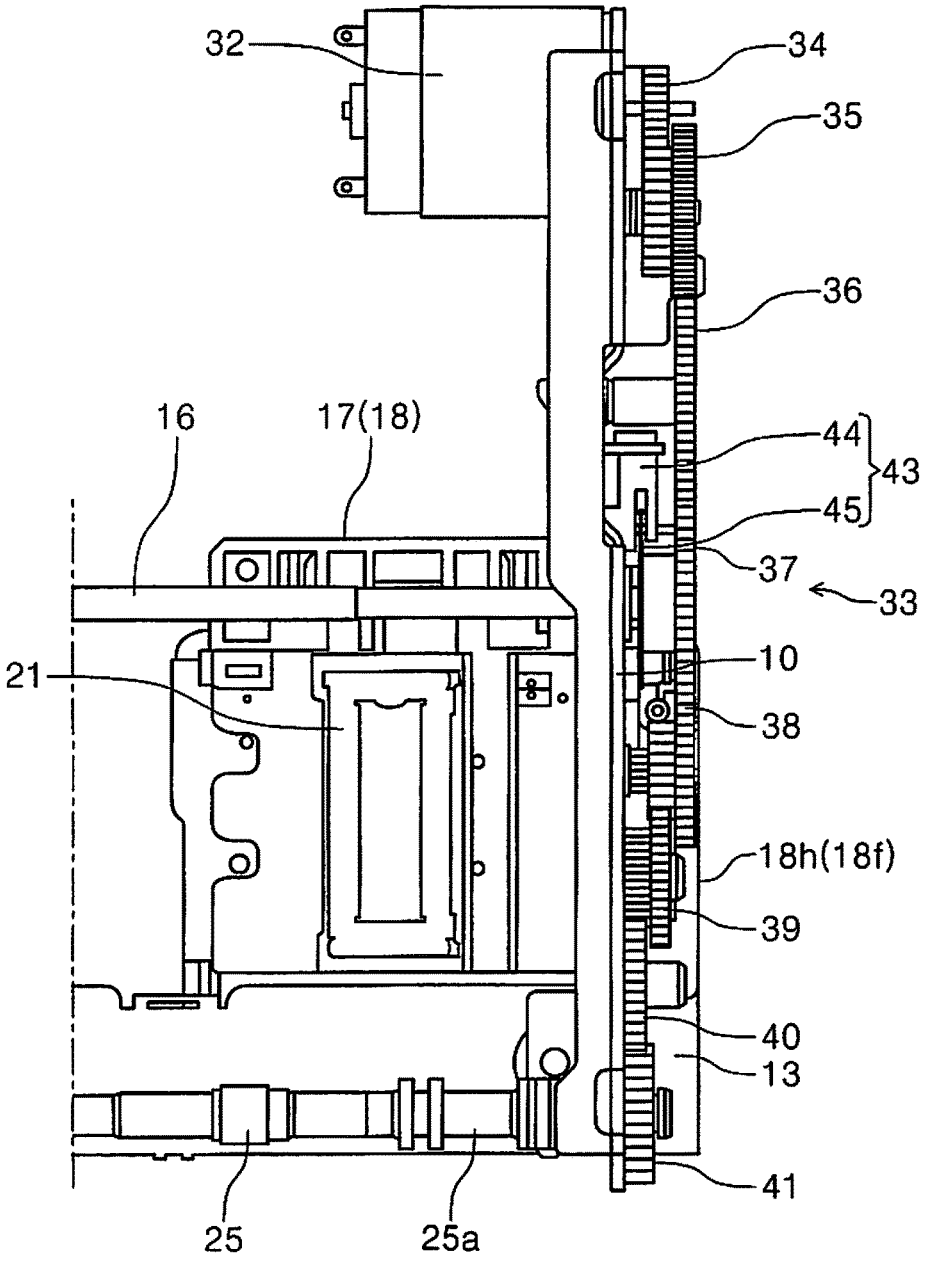
FIG. 16 is a planar diagram of the gear group and the carriage viewed from below.

In addition, FIG. 7 is a planar diagram of a carriage 17 viewed from above. FIG. 8 is a planar diagram of the carriage 17 viewed from below. FIG. 9 is a perspective diagram of the carriage 17 viewed at an incline in front of and above the apparatus. FIG. 10 is a perspective diagram of the carriage 17 viewed at an incline in front of and below the apparatus. FIG. 11 is a perspective diagram of the carriage 17 viewed at an incline behind and above the apparatus. FIG. 12 is a perspective diagram of the carriage 17 when positioned at the end part on the left side. FIG. 13 is a perspective diagram of the carriage 17 when positioned slightly closer to the home position side than the end part on the left side. Furthermore, FIG. 14 is a perspective diagram showing a gear group 33 and a rotary scale 45. FIG. 15 is a front view of the gear group 33. FIG. 16 is a planar diagram of the gear group 33 and the carriage 17 viewed from below.

Figure 17A:
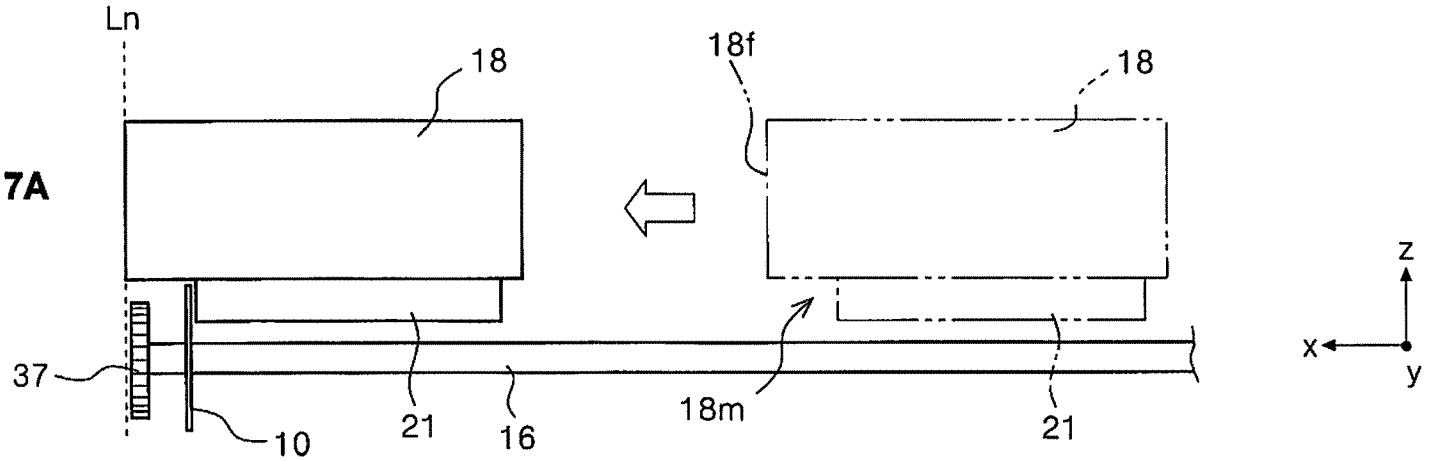
FIGS. 17A and 17B are schematic diagrams showing variations in the position of the gears with respect to the carriage.
Figure 17B:
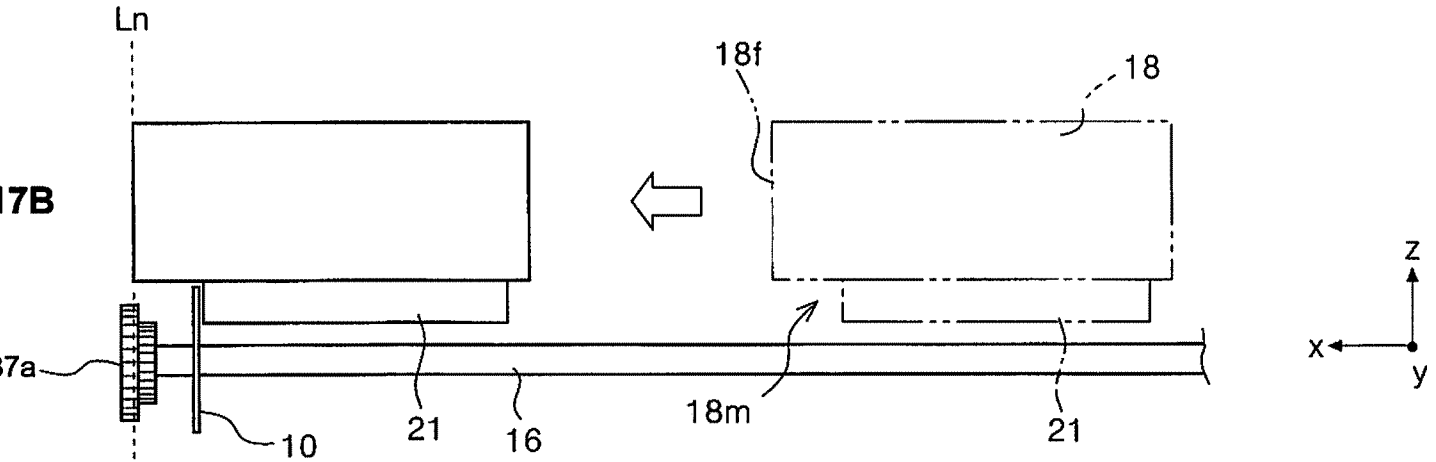
Figure 18:
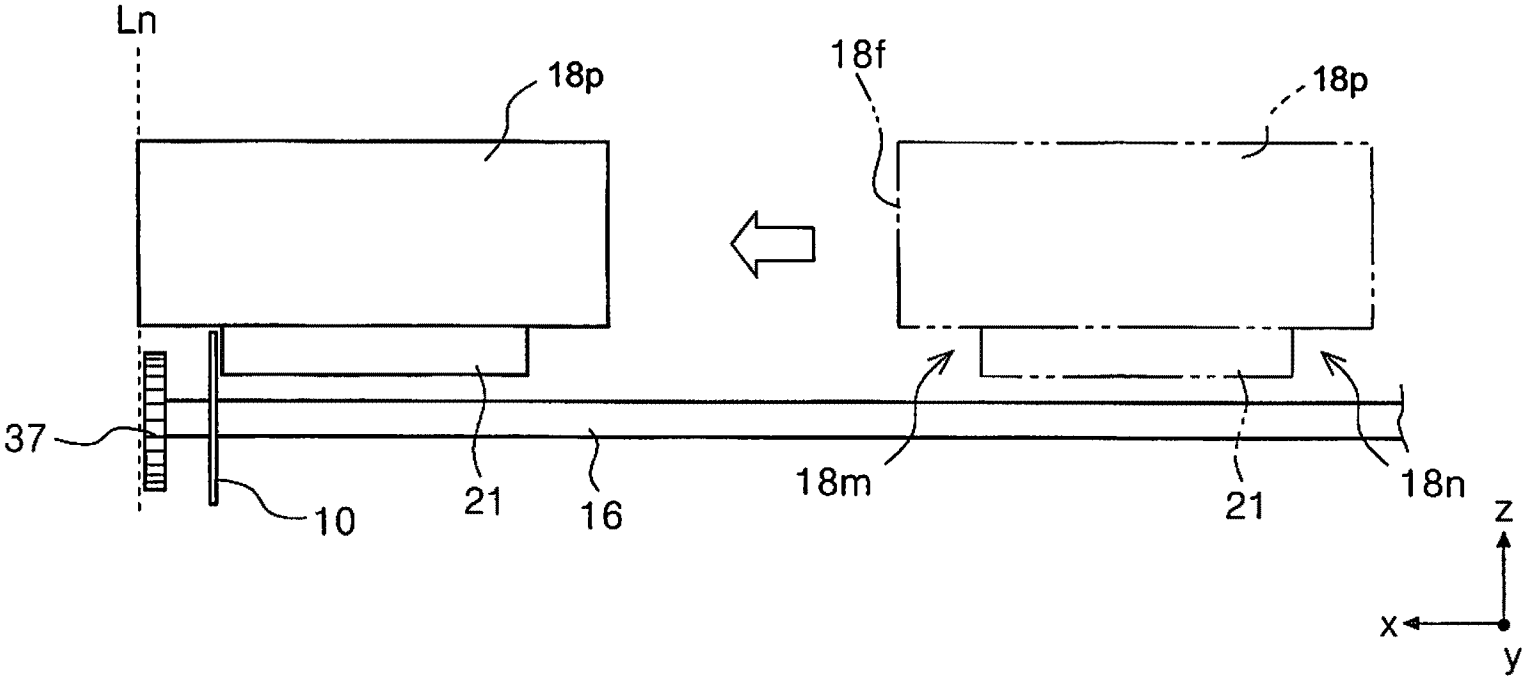
FIG. 18 is a schematic diagram showing another embodiment of the carriage.
Figure 19:
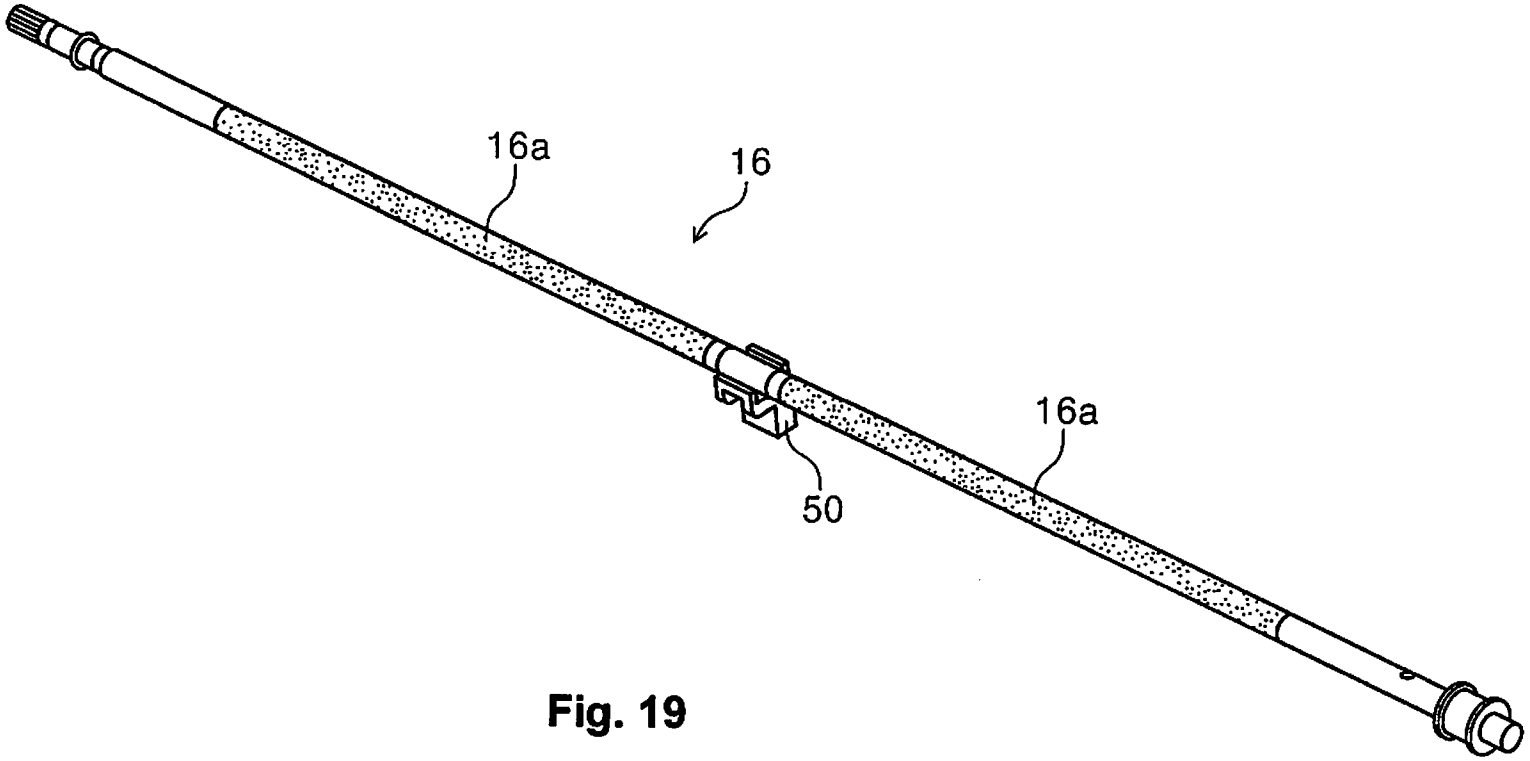
FIG. 19 is a perspective diagram of the transport drive roller.
Figure 20:
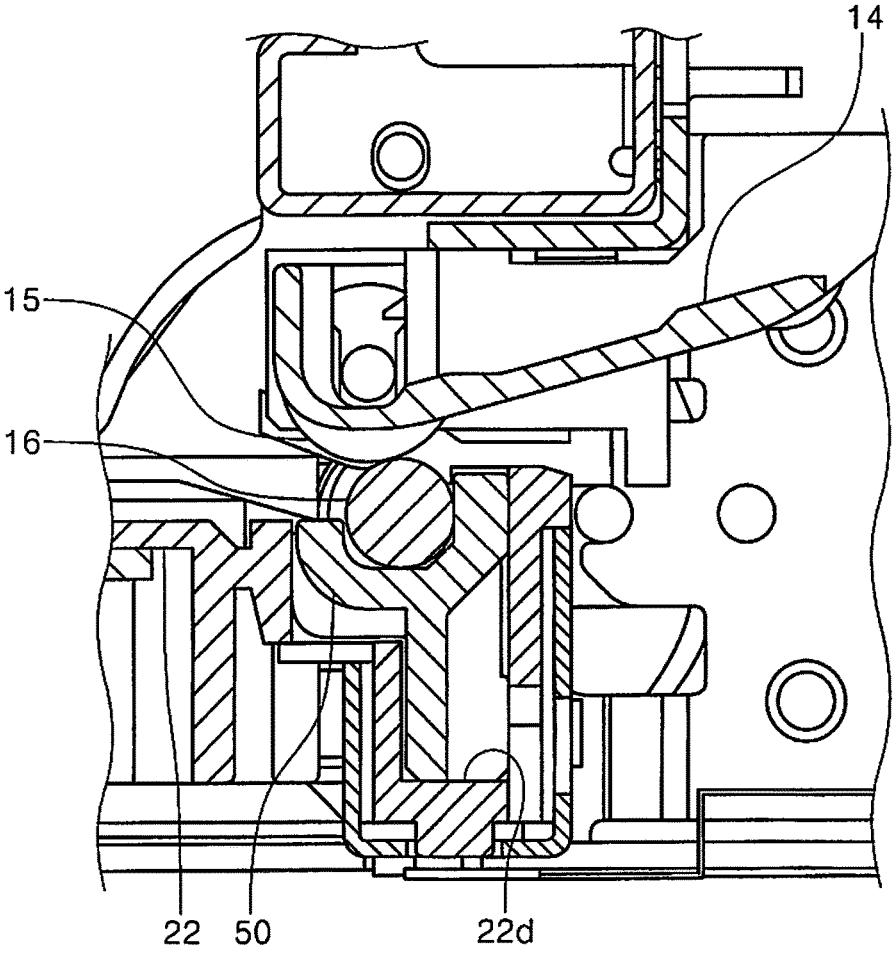
FIG. 20 shows cross-sectional diagrams of the transport drive roller, the paper support member, and the center support member.
Figure 21:
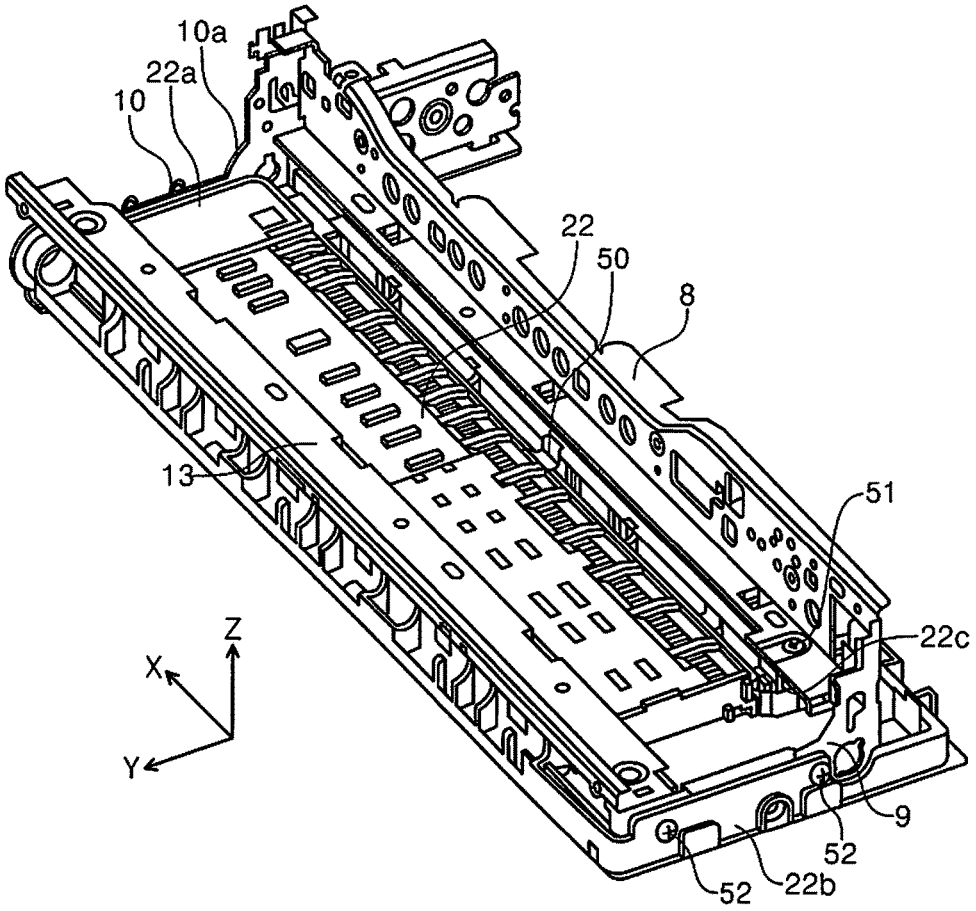
FIG. 21 shows perspective diagrams of the main frame, the side frame, the guide frame, and the paper support member.
Figure 22:
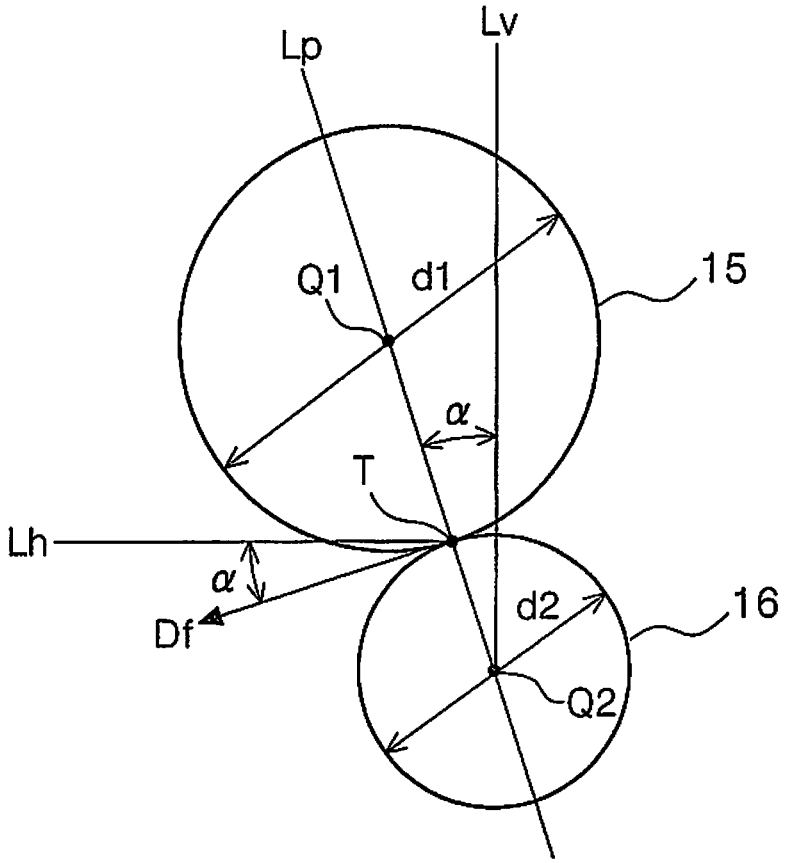
FIG. 22 is a diagram showing the positional relationships of the transport drive roller and the transport driven roller.
Figure 23A:
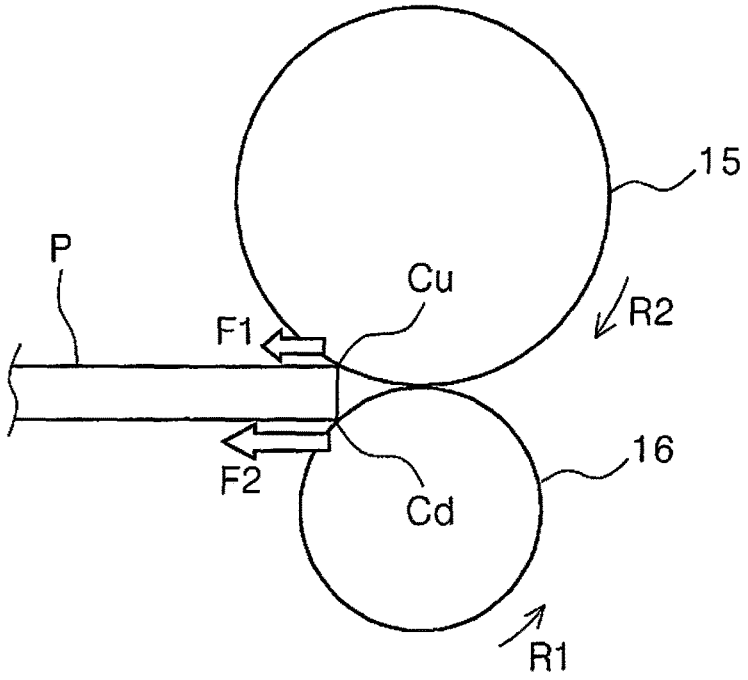
FIGS. 23A and 23B are explanatory diagrams showing the principle of pushing out the back edge of the paper by the transport drive roller and the transport driven roller.
Figure 23B:
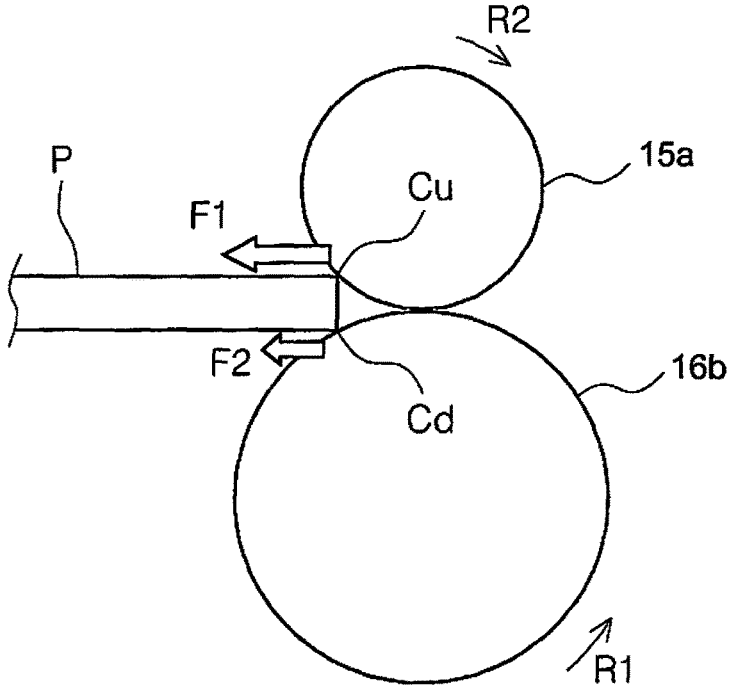

FIGS. 17A and 17B are schematic diagrams showing variations of the position of the gear with respect to the carriage 17. FIG. 18 is a schematic diagram showing another embodiment of the carriage. FIG. 19 is a perspective diagram of a transport drive roller 16. FIG. 20 shows cross-sectional diagrams of the transport drive roller 16, the paper support member 22, and the center support member 50. FIG. 21 shows perspective diagrams of the main frame 8; the side frames 9, 10; the guide frame 13; and the paper support member 22. FIG. 22 is a diagram showing the positional relationships of the transport drive roller 16 and the transport driven roller 15. FIGS. 23A and 23B are explanatory diagrams illustrating the principle of pushing the back edge of the paper by the transport drive roller 16 and the transport driven roller 15. FIG. 23A shows this embodiment. FIG. 23B shows a comparative example.

In the x-y-z orthogonal coordinate system shown in each diagram, the x direction and the y direction are in the horizontal direction. Of these, the x direction is the direction that is orthogonal to the paper transport direction (paper width direction), is the left and right direction of the apparatus, and is the movement direction (main scanning direction) of the carriage 17. The y direction is the paper transport direction and the depth direction of the apparatus. Furthermore, the z direction is the direction of gravity and the height direction of the apparatus.

The entire configuration of the printer 1 is explained below with reference to FIG. 1 to FIG. 5. Printer 1 is a so-called serial inkjet printer that alternately performs the recording operation and the paper transport operation to complete recording, is considered to be portable, and has a small-scale structure. Reference number 28 in FIG. 1 indicates a case that forms the exterior of the apparatus and is formed from resin material. Reference number 29 indicates a top cover formed from the same resin material. Reference number 30 indicates a front cover formed from the same resin material. The top cover 29 and the front cover 30 are formed as one body. When opened, an operating panel (not shown) and a paper feed slot (not shown) appear on the top surface of the apparatus. In addition, the paper ejection slot appears in the front surface of the apparatus. Reference number 30*a* is an operating lever (lock release lever) that releases the lock of the front cover 30.

The apparatus body 2 shown in FIG. 2 and FIG. 3 constitutes the inside of the case 28 described above. The apparatus body 2 constructs a skeleton from a plurality of frames. Specifically, the body is configured from a main frame 8, a side frame 9, a side frame 10, a subframe 11, a guide frame 12, and a guide frame 13 (the details will be explained later).

The back of the apparatus has a paper feed slot 3 in which recording paper (mainly, standard sheets of paper: hereinafter, referred to as "paper P") as an example of the medium, can be set. A plurality of sheets of paper P set in the paper feed slot 3 is supported at an inclined orientation by a hopper 4 and a paper support, which is not shown, that are positioned in the upper part of the hopper 4.

In FIG. 4, the hopper 4 advances and returns the supported paper P with respect to the feed roller 5 by swinging with the swinging fulcrum, which is not shown, at the center. The topmost sheet in the set paper P is placed in contact with the feed roller 5 by raising the hopper 4 and is fed to the downstream side by the rotation of the feed roller 5.

A paper transport unit provided with the transport drive roller 16 and the transport driven roller 15 is arranged downstream of the feed roller 5. Paper P is transported below an inkjet recording head 21 by the rollers. The transport drive roller 16 is driven to rotate by a motor 32 (FIG. 15, FIG. 16) as the drive source. The transport driven roller 15 is supported to enable free rotation by a roller support member 14 and is pressed toward the transport drive roller 16 by an application unit (not shown) for applying a pressing force to the roller support member 14. Then, the roller comes into contact with transported paper P and is driven to rotate. The transport drive roller 16 is formed from a solid metal shaft or a hollow metal shaft. The transport driven roller 15 is formed from a resin material (e.g., polyoxymethylene (POM)). The transport drive roller 16 and the transport driven roller 15 are explained later in more detail.

The inkjet recording head 21 is provided in the carriage 17. The carriage 17 is loaded with an ink cartridge 20, receives power from a motor 47 (FIG. 2, FIG. 3), and reciprocally moves in the direction of the paper width (x direction). In this embodiment, the right end in FIG. 2 and FIG. 3 in the movement region of the carriage 17 is the home position of the carriage 17. Here, the home position means the standby position of the carriage 17 when there is no printing or when the power is off.

Below, the movement direction of the carriage 17 when the carriage 17 is headed to the left end from the right end (home position) is set as the second direction. The movement direction of the carriage 17 when the carriage 17 is headed to the right end from the left end is set as the first direction.

Next, in the carriage 17, the case body is formed from a carriage body 18 that forms a box shape, and ink cartridges 20A, 20B are installed inside the carriage body 18. Then ink is supplied to the inkjet recording head 21 from the ink cartridges 20A, 20B. The ink cartridges 20A, 20B can be installed and removed from the carriage body 18. In FIG. 7 and FIG. 9 to FIG. 11, reference numbers 19A, 19B indicate levers (lock release levers) that release the lock on the carriage body 18 of the ink cartridges 20A, 20B.

In this embodiment, the carriage 17 is loaded with the ink cartridges 20A, 20B and is a so-called on-carriage type. The carriage may be the so-called off-carriage type in which the ink cartridges 20A, 20B are set up independent of the carriage 17, and the ink cartridges 20A, 20B and the inkjet recording head 21 are connected by ink tubes.

The carriage body 18 in FIG. 4 has a first target support part (slider) 18*a* on the front side of the apparatus and has a second target support part 18*b* on the back side of the apparatus. The first target support unit 18*a* is supported by guide frame 13. The second target support unit 18*b* is supported by guide frame 12. That is, the carriage 17 is supported by guide frame 13 and guide frame 12. In addition, the first target support unit 18*a* is supported by guide frame 13 and slides on guide frame 13.

Similarly, the second target support unit 18*b* is supported by guide frame 12 and slides on guide frame 12. Furthermore, the guide frame 12 specifies the position in the y direction of the carriage 17. That is, the guide frame 12 guides the carriage 17 in the main scanning direction. The first target support unit 18*a,* the second target support unit 18*b,* and the guide frames 12, 13 will be described later in detail.

Next, a paper support member 22 for supporting the paper P is arranged at a position that faces the inkjet recording head 21. The gap between the paper P and the inkjet recording head 21 is defined by the paper support member 22. An ejection drive roller 25 and an ejection driven roller 26 for ejecting paper P that has been recorded are provided on the downstream side of the inkjet recording head 21 and the paper support member 22. Reference number 25*a* is the rotation shaft of the ejection drive roller 25. A plurality of ejection drive rollers 25 is installed at appropriate intervals along the direction of the axial line of the rotation shaft 25*a* (see FIG. 2, FIG. 3). In addition, reference number 24 is a control roller that controls the paper lift.

Next, the frame that constitutes the skeleton of the apparatus body 2 is explained. In FIG. 2, FIG. 3, and FIG. 21, the main frame 8, the subframe 11, and the guide frames 12, 13 form a shape that extends in the width direction of the paper. Side frames 9, 10 form a shape that extends in the paper transport direction. FIG. 3 and FIG. 21 show the state in which the subframe 11 is removed from the state in FIG. 2 to expose the guide frame 13.

The main frame 8 forms a shape that extends in the vertical direction as shown in FIG. 4 in a cross-sectional plane view, and the upper part is bent into the shape of the letter L on the back side of the apparatus, and the lower part is bent into the shape of the letter L on the front side of the apparatus. A paper feed unit that includes the hopper 4 and the feed roller 5 is installed, and various structural parts, such as the motor 47 that drives the carriage 17 or a roller support member 14 that supports the transport driven roller 15, are assembled in the main frame 8.

The guide frame 12 extends in the vertical direction as shown in FIG. 4 in the cross-sectional plane view, and the lower part is bent to the front side of the apparatus, then bent upward, and then bent to the back side of the apparatus to form a shape resembling a hook. More specifically, reference number 12*a* in FIG. 5 indicates the part that extends in the vertical direction in the cross-sectional plane view of the guide frame 12 (hereinafter, the "perpendicular part 12*a*"). Reference number 12*b* indicates a part that extends in the horizontal direction (hereinafter, the "horizontal part 12*b*"). Reference number 12*c* indicates a part that extends in the vertical direction (hereinafter, the "second perpendicular part 12*c*"). Reference number 12*d* indicates a part that extends in the horizontal direction (hereinafter, the "second horizontal part 12*d*"). Thus, by forming a hook-like shape in the cross-sectional plane view, an improvement is designed for the rigidity in the lengthwise direction (paper width direction) of the guide frame 12.

The top surface (reference number 12*e*) of the horizontal unit 12*b* in guide frame 12 becomes a sliding surface on which a slider 18*c* (see FIG. 8, FIG. 10) that is provided in the carriage body 18 slides. In addition, sliders 18*d,* 18*e* are provided in the carriage body 18. Of these, slider 18*d* is provided to be able to advance and return with respect to the slider 18*e* and press against the slider 18*e* side. Thus, the second vertical unit 12*c* becomes sandwiched by slider 18*d* and slider 18*e*. Then, the sliders 18*d*, 18*e* slide with the second vertical unit 12*c* accompanying the movement action of the carriage 17. Reference number 12*f* indicates the sliding surface on which slider 18*d* slides. Reference number 12*g* indicates the sliding surface on which slider 18*e* slides. Thus, the surfaces of these sliding surfaces 12*e*, 12*f*, 12*g* are preferably formed to be smooth.

In addition, the guide frame 13 provided in the front of the apparatus is formed into a hook shape by extending in the horizontal direction, bending up the end part on the front side of the apparatus, then bending horizontal to the back side of the apparatus, as shown in FIG. 4 in the cross-sectional plane view. More specifically, reference number 13*a* in FIG. 6 indicates a part that extends in the horizontal direction in the cross-sectional plane view of the guide frame 13 (hereinafter, the "horizontal part 13*a*"). Reference number 13*b* indicates a part that extends in the perpendicular direction (hereinafter, the "perpendicular part 13*b*"). Reference number 13*c* indicates a part that extends in the horizontal direction (hereinafter, the "second horizontal part 13*c*"). Thus, by forming a hook-like shape in the cross-sectional plane view, an improvement is designed for the rigidity in the lengthwise direction (paper width direction) of the guide frame 13.

The top surface (reference number 13*d*) of the horizontal part 13*a* in the guide frame 13 becomes the sliding surface on which the first target support unit 18*a* (see FIG. 8 and FIG. 10) provided in the carriage 17 slides. Consequently, the sliding surface 13*d* is preferably formed to be smooth.

Next, returning to FIG. 2, FIG. 3, and FIG. 21, the side frames 9, 10 are in contact with the end parts of guide frames 12, 13, respectively. Various elements are assembled to construct the paper transport path, such as the transport drive roller 16, the ejection drive roller 25, and the paper support member 22 that were explained with reference to FIG. 2. In the paper support member 22, the left end part 22*a* shown in FIG. 21 is fixed by screws, which are not shown, to the side frame 10. The right end part 22*b* is fixed by screws 52, 52 to side frame 9. That is, the end parts in the x direction of the paper support member 22 are supported by the side frames 9, 10.

In addition, in the paper support member 22, a center part 22*c* that is slightly closer to the center than the right end part 22*b* is fixed by screws 51 to the main frame 8. That is, in the paper support member 22, the end parts in the x direction are supported by side frames 9, 10, and the interval therebetween is supported by main frame 8. Thus, bending (depressing) is effectively prevented in the x direction of the paper support member 22. The function of the paper support member 22 will be further explained later.

The carriage 17 (carriage body 18) related to this embodiment is explained next with reference to FIG. 7 and later drawings. In the carriage 17, the carriage body 18 that forms a box shape as described above constitutes the case. Reference number 18*h* in FIG. 9 is the side surface on the second direction side (hereinafter, referred to as the "left side surface") of the side surfaces that constitute the periphery of the carriage body 18. Reference number 18*g* in FIG. 10 is the side surface on the first direction side (hereinafter, referred to as the "right side surface").

In addition, reference number 18*f* in FIG. 7 to FIG. 9 and FIG. 11 indicates a projecting part that projects out in the second direction (direction opposite the home position of the carriage 17). The projecting part 18*f* is a part of region A indicated in FIG. 7 and FIG. 8 in the carriage body 18 and indicates the part that projects out in the second direction side from the second target support unit 18*b* in the embodiment.

More specifically, the straight line Cu in FIG. 8 is a line that is parallel to the y direction and passes through the center point between two sliders 18*c*, 18*c* arranged with the predetermined interval in the carriage movement direction. The range ws indicates the target support region that supports the second target support unit 18*b* with the guide frame 12 as the support unit. The carriage body 18 is formed with a projecting unit 18*f* and forms an asymmetric shape in the carriage movement direction (x direction) with respect to the straight line Cu passing through the center position of the target support region ws.

The reference symbol At is a triangular region enclosed by the straight lines that pass through the two sliders 18*c*, 18*d* and the first target support unit (slider) 18*a*. The center of gravity of the carriage 17 is positioned inside this region At in the planar view.

Next, a belt clamp unit 18*k* shown in FIG. 11 is provided in the back surface side of the carriage body 18. The belt clamp unit 18*k* is a part that clamps (holds) the endless belt 48. The belt clamp unit 18*k* receives the drive power from the endless belt 48. The endless belt 48 passes over the entire carriage movement region, receives power from a motor 47 (FIG. 2, FIG. 3) to operate, and moves the carriage 17.

Next, the gear group 33 is explained as the power transmission mechanism for transmitting the power of the motor 32 (FIG. 15, FIG. 16) to the transport drive roller 16 and the ejection drive roller 25 that constitute the transport unit for transporting the paper P. The motor 32 is provided on the back side in the forward and backward direction of the apparatus. The gear group 33 is provided with a plurality of gears so that power is transmitted to the transport drive roller 16 that is positioned in the center in the forward and backward direction of the apparatus and the ejection drive roller 25 (rotation shaft 25*a* thereof) that is positioned on the front side in the forward and backward direction of the apparatus.

Each gear constituting the gear group 33 is arranged in the side frame 10, more specifically, is arranged to the outside of the side frame 10 (outside of the apparatus). The gear group 33 is configured from gears 34, 35, 36, 37, 38, 39, 40, 41 in order from the motor 32 side as shown in FIG. 15 and FIG. 16. Gear 34 is the gear arranged on the rotation shaft of the motor 32. Gear 37 is the gear arranged at the shaft end of the transport drive roller 16 as the first roller (first roller drive gear). Gear 41 is the gear arranged at the shaft end of the ejection drive roller 25 (rotation shaft 25*a* thereof) as the second roller (second roller drive gear). The gear group 33 transmits power through gear 37 to the ejection drive roller 25 (rotation shaft 25*a* thereof).

In addition to gear 37, the rotary scale 45 is arranged on the shaft end of the transport drive roller 16 (FIG. 13, FIG. 14). The rotary scale 45 configures a rotation detection unit 43 that detects the rotation of the transport drive roller 16 and is arranged so that a detection unit 44 (FIG. 16) that detects the rotation of the rotary scale 45 sandwiches the outer peripheral part of the rotary scale 45. The rotary scale 45 and the detection unit 44 configure the rotation detection unit 43. A control unit, which is not shown, in the printer 1 can determine the amount of rotation and the direction of rotation of the transport drive roller 16 and the ejection drive roller 25 based on the detection signal from the rotation detection unit 43.

In the above configuration, FIG. 12 and FIG. 16 show the state in which the carriage 17 is positioned at the end part in the second direction. As illustrated, of the gears configuring the gear group 33, gears 38, 39 in this embodiment are entirely positioned below the carriage 17, and parts of gears 37, 40 are positioned below the carriage 17.

Because at least a portion of the gear group 33 is positioned below the carriage 17 when moved to the end part in the second direction, the gear group 33 entered into the region required in the movement of the carriage 17. Thus, the width dimension of the apparatus can be limited. Additionally, because the width dimension of the apparatus can be limited even when the width of the carriage 17 is ensured, the volume of the carriage 17, namely the volumes of the ink cartridges 20A, 20B, can be ensured.

In addition, the carriage 17 in this embodiment is provided with a projecting part 18*f* that projects in the second direction. Therefore, the volume of the carriage 17 can be ensured by the projecting part 18*f*, and at least a portion of the gear group 33 is positioned below the projecting unit 18*f* in the carriage 17 when moved to the end part in the second direction. Thus, an increase in the width dimension of the apparatus can be limited. Additionally, an increase in the height dimension of the apparatus can be limited because the volume of the carriage can be ensured without increasing the carriage body 18 in the height direction.

Then the ink cartridge 20B occupies the space that includes the projecting unit 18*f* in the carriage 17; therefore, the ink volume in the ink cartridge 20B can be ensured.

In this embodiment, the rotary scale 45 that constitutes the rotation detection unit 43 for detecting the rotation of the transport drive roller 16 as the first roller is formed with a diameter smaller than that of the gear 37 as the first roller drive gear. Due to this, the rotary scale 45 can be protected particularly from external pressure from above the apparatus. Thus, the rotary scale 45 is arranged on the first direction side (side frame 10 side) with respect to the gear 37. Therefore, the detection unit 44 that reads the rotary scale 45 is arranged between the gear group 33 and the side frame 10. Consequently, it is possible to prevent positioning the detection unit 44 at the outermost side of the apparatus body (outside in the carriage movement direction), and the increase in the dimensions (dimension in the carriage movement direction) of the apparatus body can be limited.

In addition, the rotary scale 45 easily degrades the detection precision because of weaker strength or slight deformation, and is readily connected to degradation of the recording quality. However, in this embodiment, because the rotary scale 45 is arranged on the first direction side with respect to the gear 37 as the first roller drive gear (side frame 10 side), the rotary scale 45 and the detection unit 44 can be protected from external pressure from the sides of the apparatus.

In addition, a convex part 10*a* forming an arc shape that is along the outer shape of the rotary scale 45 as shown in FIG. 13 and has a diameter larger than the diameter of the rotary scale 45 is formed in the side frame 10 that supports the transport drive roller 16. Therefore, the convex part 10*a* has the function of a shielding wall for the rotary scale 45 and is able to prevent the adhesion of ink mist to the rotary scale 45.

A concave part 18*j* is formed in the carriage body 18 to avoid the convex part 10*a* when the carriage 17 is positioned at the end part in the second direction (FIG. 11). That is, when the carriage 17 is positioned at the end part in the second direction (state shown in FIG. 12), the convex part 10*a* enters the concave part 18*j*. Due to this, in order to ensure the movement region of the carriage 17 (in order to prevent interference of the carriage body 18 and the side frame 10), the position of the side frame 10 does not have to be set on the outside, and an increase in the width dimension of the apparatus can be limited.

The embodiment described above is one example. Needless to say, the present invention is not limited to the embodiment described above. For example, FIG. 17A is a drawing schematically showing the embodiment described above. The carriage body 18 moves in the direction of the arrow from the position indicated by the two-dot-dash line and positioned at the endmost part, the gear 37 enters entirely below the carriage body 18 in the carriage movement direction (x direction). However, the configuration is not limited to this embodiment and may have a portion of the gear (reference number 37*a*) in the carriage movement direction (x direction) enter below the carriage body 18 as shown in FIG. 17B. The dashed line indicated by the symbol Ln is the position of the left side surface 18*h* of the carriage body 18. In addition, reference number 18*m* is a concave part that is formed in the lower part on the left side of the carriage body 18. The concave part 18*m* is a concave part that is formed below the projecting unit 18*f* by the projecting unit 18*f* described above.

In addition, the carriage body 18*p* shown in FIG. 18 forms a shape with right-left symmetry, which is different than the embodiment described above, in the carriage movement direction (x direction). That is, the concave part 18*m* and a concave part 18*n* on the opposite side are formed to have the same size. When the carriage body 18*p* having this kind of shape is positioned at the end part in the movement direction, the gear 37 can be constructed to enter the concave part 18*m*.

In addition, the various implementation examples below can be adopted. For example, the carriage 17 in this embodiment is supported and guided in the movement direction by guide frames 12, 13, but may be supported and guided in the movement direction by the shaft.

Next, the transport drive roller 16 and the transport driven roller 15 are explained in further detail with reference to FIG. 19 and later drawings. In FIG. 19, the transport drive roller 16 is provided with a high friction layer 16*a* in which abrasion-resistant particles are nearly uniformly dispersed on the outer peripheral surface of the shaft body (metal core shaft or hollow metal shaft) that extends in the width direction of the paper. The right and left shaft ends thereof are supported by the side frames 9, 10 (FIG. 2).

The high friction layer 16*a* does not have to be formed in the center part of the transport drive roller 16. The center part is supported by a center support member 50 as shown in FIG. 19 and FIG. 20. By supporting the center part as well as the two end parts of the transport drive roller 16 by the center support member 50, bending of the transport drive roller 16 is suppressed, and good paper transport accuracy can be ensured.

The center support member 50 is arranged in the paper support member 22. Reference number 22*d* in FIG. 20 is a support part that supports the center support member 50 in the paper support member 22. By having the paper support member 22 arrange (support) the center support member 50 that supports the center part of the transport drive roller 16, a bent shape (depression in the center part) of the paper support member 22 in the x direction and the extent of bending, and the bent shape (depression in the center part) of the transport drive roller 16 and the extent of bending can be equal for the most part.

Due to this, the relative positional relationship of the paper support member 22 and the transport drive roller 16 does not fluctuate over the x direction (paper width direction), namely the orientation of the paper can be stable over the x direction (paper width direction), and the degradation of the recording quality can be suppressed.

In the paper support member 22 described above, as explained with reference to FIG. 21, the end parts in the x direction are supported by side frames 9, 10, and the center part 22*c* therebetween is supported by the main frame 8. Due to this, bending (depression) in the x direction of the paper support member 22 is effectively prevented. As a result, bending (depressing in the center part) of the transport drive roller 16 can be effectively suppressed, and better recording quality can be obtained. In addition, the gap between the inkjet recording head 21 and the paper P is stable over the x direction (paper width direction), and degradation of the recording quality can be suppressed.

Next, FIG. 22 illustrates the positional relationship of the transport drive roller 16 and the transport driven roller 15. Reference symbol Q1 indicates the shaft center position of the transport driven roller 15. Reference symbol Q2 indicates the shaft center position of the transport drive roller 16. In addition, reference symbol T indicates the contact position of the transport drive roller 16 and the transport driven roller 15. Additionally, reference symbol Lv indicates a vertical line that passes through the shaft center position Q2. Reference symbol Lp indicates the straight line that passes through shaft center position Q1 and shaft center position Q2. Reference symbol Lh indicates the horizontal line that passes through the contact position T. In addition, reference symbol $\alpha$ indicates the angle formed by the vertical line Lv and the straight line Lp. In addition, reference symbol d1 indicates the diameter of the transport driven roller 15. Reference symbol d2 indicates the diameter of the transport drive roller 16.

The diameter d1 of the transport driven roller 15 in the embodiment is set to be larger than the diameter d2 of the transport drive roller 16. In addition, by setting the angle $\alpha$ to $0° < \alpha < 90°$, the advancing direction of the paper P sent from between the transport drive roller 16 and the transport driven roller 15 points at an incline downward as indicated by arrow Df. Due to this, the paper P sent from between the transport drive roller 16 and the transport driven roller 15 is pushed toward the paper support member 22 (FIG. 4). Thus, paper is kept from floating at the position opposite the inkjet recording head 21, and good recording effects are obtained.

The actions and effects obtained by setting diameter d1 of the transport driven roller 15 to be larger than diameter d2 of the transport drive roller 16 are explained below with reference to FIGS. 23A and 23B. In FIG. 23A, to facilitate the explanation, the angle $\alpha$ shown in FIG. 22 is set to zero in the drawing. However, in practice, a predetermined angle $\alpha$ is set as shown in FIG. 22.

In FIG. 23A shown in the embodiment, reference symbol Cu indicates the corner where the back edge of the paper is pushed out by the transport driven roller 15. Reference symbol Cd indicates the corner where the back edge of the paper is pushed out by the transport drive roller 16.

The transport driven roller 15 is pressed toward the transport drive roller 16, namely the paper P is pressed between the transport driven roller 15 and the transport drive roller 16. When the back edge of the paper is removed from both rollers, a pushing force is received from both rollers. Reference symbol F1 indicates the pushing force applied by the transport driven roller 15 to the back edge corner Cu. Reference symbol F2 indicates the pushing force applied by the transport drive roller 16 to the back edge corner Cd. In this embodiment, the pushing force F2 by the transport drive roller 16 that has the relatively smaller diameter becomes larger than the pushing force F1 by the transport driven roller 15 that has the relatively larger diameter.

Here, when the back edge of the paper is pushed out from between the transport driven roller 15 and the transport drive roller 16, the rotation R2 of the transport driven roller 15 is free rotation and acts so that the back edge of the paper is forcefully pushed out. However, because the transport drive roller 16 is connected to the drive source and is unable to freely rotate, the rotation R1 of the transport drive roller 16 does not act to forcefully push out the back edge of the paper compared to the rotation R2 of the transport driven roller 15.

In this embodiment, these properties are used, and the transport driven roller 15 that acts to forcefully push out the back edge of the paper has a larger diameter than that of the transport drive roller 16 so that the pushing force F1 accompanying the pressing force is relatively small (d1>d2). As a consequence, the kicking phenomenon can be appropriately suppressed by this simple structure.

In order to compare this embodiment, FIG. 23B is a diagram that illustrates a comparative example, which is the case in which the diameter of the transport driven roller 15*a* is set to be smaller than the diameter of the transport drive roller 16*b*. In this case, pushing force F1 shown in the drawing becomes larger than pushing force F2. Consequently, the transport driven roller 15 (capable of free rotation) that rotates so that the back edge of the paper is forcefully pushed out will forcefully push out the back edge of the paper accompanying a relatively large pushing force F1. Thus, the kicking phenomenon becomes evident.

By setting the diameter d1 of the transport driven roller 15 to be larger than the diameter d2 of the transport drive roller 16, the effect of degradation of the assembly precision of the apparatus can be reduced. That is, as explained with reference to FIG. 22, the angle $\alpha$ is set, and based on this, the advance direction of the paper P sent from between the transport drive roller 16 and the transport driven roller 15 is directed downward at an incline as indicated by arrow Df. This angle $\alpha$ is important from the perspective of obtaining good recording quality.

However, when the position of the transport driven roller 15 is forward and backward in the horizontal direction due to a reduction in the assembly precision of the transport driven roller 15, the angle $\alpha$ also changes with it. The rate of change of this angle $\alpha$ becomes larger as the diameter d1 of the transport driven roller 15 becomes smaller. Because the diameter d1 of the transport driven roller 15 is set to a large value in this embodiment, fluctuations in the angle a accompanying fluctuations in the position of the transport driven roller 15 are suppressed, and good recording quality can be obtained.

As explained above, a recording apparatus related to one embodiment is provided with a carriage including a recording head configured to record on the medium and move in a first direction and a second direction that is an opposite direction thereto, a support unit supporting the carriage, and a power transmission mechanism configured to transmit power of a drive source to a transport unit configured to transport the medium. At least a part of the power transmission mechanism is positioned below the carriage that is moved to an end part in the second direction.

According to this embodiment, the power transmission mechanism is incorporated into the region required for the movement of the carriage because at least a part of the power transmission mechanism is positioned below the carriage when moved to the end part in the second direction. Thus, the width dimension of the apparatus can be limited, and the carriage volume can be ensured.

The carriage may be provided with a projection unit that projects in the second direction, forms an asymmetric form in a movement direction with respect to the center of a target support region that is supported by the support unit in the movement direction, and at least a part of the power transmission mechanism is positioned below the projecting part of the carriage when moved to the end part in the second direction.

According to this embodiment, because the carriage is provided with a projecting part that projects in the second direction, the volume of the carriage can be ensured by the projecting part, and at least a part of the power transmission mechanism below the projecting part of the carriage when moved to the end part in the second direction. Thus, an increase in the width direction and an increase in the height direction of the apparatus can be limited.

The carriage may be provided with an ink cartridge configured to store ink, the ink cartridge is detachably arranged to the carriage, and the ink cartridge is arranged to occupy a space that includes the projecting part in the carriage.

According to this embodiment, the ink cartridge storing the ink occupies space that includes the projecting part in the carriage; therefore, the volume of ink in the ink cartridge can be ensured.

The transport unit may be provided with a first roller provided on an upstream side of the recording head and a second roller provided on the downstream side of the recording head in the transport path of the medium, the power transmission mechanism includes a first roller drive gear provided in a shaft end unit of the first roller and is configured to transmit power to the second roller through the first roller drive gear, and a rotary scale that constitutes a rotation detection unit configured to detect a rotation of the first roller is provided on a side of the first direction with respect to the first roller drive gear.

According to this embodiment, because the rotary scale is provided on the first direction side with respect to the first roller drive gear, the placement of a detection unit that reads the rotary scale on the outermost side (outside in the carriage movement direction) of the apparatus body can be avoided; and an increase in the dimensions of the apparatus body (dimension in the carriage movement direction) can be limited.

A diameter of the rotary scale may be smaller than a diameter of the first roller drive gear.

According to this embodiment, because the diameter of the rotary scale is smaller than the diameter of the first roller drive gear, the rotary scale can be protected from external pressure from above the apparatus.

A frame supporting the first roller may be provided, and the frame has a convex part that is along the exterior shape of the rotary scale and has an arc shape having a diameter larger than the diameter of the rotary scale.

According to this embodiment, because the convex part formed in the frame forms an arc shape that is along the exterior shape of the rotary scale and has a diameter larger than the diameter of the rotary scale, the convex part has the function of a shielding wall for the rotary scale and prevents ink mist from adhering to the rotary scale.

The carriage may have a concave part that avoids the convex part when the carriage moved to the end part in the second direction.

According to this embodiment, because a concave part is formed in the carriage to avoid the convex part formed in the frame when the carriage was positioned at the end part in the second direction, an increase in the width dimension of the apparatus can be limited without the need to set the position of the frame on the outside in order to ensure the movement region of the carriage (in order to prevent interference of the carriage and the frame).

A recording apparatus related to one embodiment is provided with a recording head configured to record on a medium, a drive roller configured to transport the medium to a side of the recording head and be driven by a drive source, and a driven roller that is configured to be driven to rotate while the driven roller is pressed toward the drive roller and is in contact with the medium, and that has a diameter larger than that of the drive roller.

According to this embodiment, the diameter of the driven roller is larger than the diameter of the drive roller and obtains the following actions and effects. That is, the back end of the medium is pressed between the driven roller and the drive roller. Then for the pushing force accompanying the pressing force of the driven roller, the pushing force by the drive roller that has a relatively small diameter becomes larger than the pushing force by the driven roller that has a relatively large diameter.

Here, when the back end of the medium is pushed out from between the driven roller and the drive roller, the rotation of the driven roller acts to forcefully push out the back end of the medium because the driven roller is capable of free rotation. However, because the drive roller is connected to the drive source and is unable to rotate freely, the drive roller does not act to forcefully push out the back end of the medium compared with the driven roller.

In this embodiment, the driven roller that uses these properties and acts to forcefully push out the back end of the medium has a larger diameter than that of the drive roller so that the pushing force accompanying the pressing force is relatively small. Consequently, the kicking phenomenon can be appropriately suppressed with a simple structure.

A medium support member that supports the medium may be provided at a position that faces the recording head, and the medium that is sent out from between the drive roller and the driven roller is pressed against the medium support member.

According to this embodiment, the medium support member that supports the medium is provided at a position that can be opposite the recording head. The medium sent from between the drive roller and the driven roller pushes against the medium support member. Therefore, the floating up of the medium at the position opposite the recording head can be effectively suppressed.

The drive roller may be formed with particles affixed to an outer peripheral surface of a solid shaft or a hollow shaft, and the driven roller is formed from resin material.

A carriage including the recording head and configured to move in a first direction and a second direction that is an opposite direction thereto, a support unit supporting the carriage, and a power transmission mechanism t configured to transmit power of a drive source to the drive roller may be further provided, and at least a part of the power transmission mechanism is positioned below the carriage when moved to an end part in the second direction.

According to this embodiment, because at least a part of the power transmission mechanism is positioned below the carriage when moved to the end part in the second direction, the power transmission mechanism enters into the region required in carriage movement. Due to this, the width dimension of the apparatus can be limited, and the carriage capacity can be ensured.

An ejection roller configured to eject the medium may be provided on a downstream side with respect to the recording head in a transport path of the medium. The power transmission mechanism includes a first roller drive gear provided at a shaft end unit of the drive roller and is configured to transmit power to the ejection roller through the first roller drive gear. A rotary scale that constitutes a rotation detection unit configured to detect a rotation of the drive roller is provided on a side of the first direction side with respect to the drive roller drive gear.

According to this embodiment, because the rotary scale is provided on the first direction side with respect to the first roller drive gear, it is possible to avoid positioning the detection unit that reads the rotary scale on the outermost side of the apparatus body (outer side in the carriage movement direction) and to limit the increase in the dimensions of the apparatus body (dimension in the carriage movement direction).

The diameter of the rotary scale may be smaller than the diameter of the first roller drive gear.

According to this embodiment, a diameter of the rotary scale is smaller than a diameter of the first roller drive gear. Therefore, the rotary scale can be protected from external pressure from above the apparatus.

A frame supporting the drive roller may be provided, and the frame has a convex part that has an arc shape with a diameter larger than the diameter of the rotary scale and is along an external shape of the rotary scale.

According to this embodiment, because the convex part formed in the frame is along the outer shape of the rotary scale and has an arc shape having a diameter larger than the diameter of the rotary scale, the convex part has the function of a shielding wall for the rotary scale and prevents the adhesion of ink mist to the rotary scale.

The carriage may have a concave part that avoids the convex part when the carriage was moved to the end part in the second direction.

According to this embodiment, because the concave part formed in the carriage avoids the convex part formed in the frame when the carriage is positioned at the end part in the second direction, an increase in the width dimension of the apparatus can be limited without the need to set the position of the frame on the outside in order to ensure the movement region for the carriage (in order to prevent interference of the carriage and the frame).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a carriage including a recording head configured to record onto a medium, the carriage being configured to move in a movement region in a first direction and a second direction that is an opposite direction thereto;

a transport drive roller configured to transport the medium to a recording region in which the recording head performs recording;

a plurality of gears configured to transmit power of a motor to the transport drive roller;

a guide frame configured to movably support the carriage; and a side frame being in contact with the guide frame and supporting the transport drive roller, when the carriage is positioned at an end of the movement region in the second direction, at least a portion of one of the plurality of gears overlapping the carriage when viewed along a vertical direction that is parallel to a direction of gravity and overlapping the recording head when viewed along an axial direction of the transport drive roller, and when the carriage is positioned at the end of the movement region in the second direction, at least a portion of the side frame overlapping the carriage when viewed along the vertical direction and overlapping the recording head when viewed along the axial direction of the transport drive roller.

2. The recording apparatus according to claim 1, further comprising a rotary encoder scale coaxially arranged with the one of the plurality of gears, the rotary encoder scale having a diameter smaller than that of the one of the plurality of gears, the rotary encoder scale being arranged between the side frame and the one of the plurality of gears.

* * * * *